US005571267A

United States Patent [19]

Yokoi et al.

[11] Patent Number: 5,571,267

[45] Date of Patent: Nov. 5, 1996

[54] TARGET HITTING GAME MACHINE

[75] Inventors: Hidekazu Yokoi, Zama; Yuichiro Sagawa, Yamato; Shinichi Wada, Zama, all of Japan

[73] Assignee: Konami Co., Ltd., Hyogo-ken, Japan

[21] Appl. No.: 524,696

[22] Filed: Sep. 7, 1995

[30] Foreign Application Priority Data

Sep. 9, 1994 [JP] Japan ..... 6-216327

[51] Int. Cl.[6] ..... A63F 9/00

[52] U.S. Cl. ..... 273/446

[58] Field of Search ..... 273/445, 446, 273/359

[56] References Cited

U.S. PATENT DOCUMENTS

| | | | |
|---|---|---|---|
| 4,224,761 | 9/1980 | Wakimura . | |
| 4,461,475 | 7/1984 | Nakamura . | |
| 4,627,620 | 12/1986 | Yang | 273/446 |
| 4,973,053 | 11/1990 | Kobayashi | 273/446 |

FOREIGN PATENT DOCUMENTS

| | | |
|---|---|---|
| 276136 | 7/1988 | European Pat. Off. . |
| 0353705 | 2/1990 | European Pat. Off. . |
| 0403130 | 12/1990 | European Pat. Off. . |
| 54-134588 | 9/1979 | Japan . |
| 57-170276 | 10/1982 | Japan . |

*Primary Examiner*—Paul E. Shapiro
*Attorney, Agent, or Firm*—Jordan and Hamburg

[57] ABSTRACT

A target hitting game machine includes a cover member being formed with an opening; a target having an effective hitting area on a portion of the surface thereof, the target being rotatably disposed in the cover member and partially exposed through the opening during the rotation; a drive mechanism which rotates the target; an exposure detector which detects that the effective hitting area of the target is exposed through the opening; a hit detector which senses that the target is hit by a player; and a successful hitting determinator which is in responsive to the exposure detector and the hit detector and determines a successful hitting that the effective hitting area is hit.

10 Claims, 17 Drawing Sheets

TARGET HITTING GAME MACHINE

BACKGROUND OF THE INVENTION

This invention relates to a target hitting game machine, such as a so-called "whack-a-mole" game machine, in which a player hits imitation moles or like targets randomly emerging from openings in a playing board.

Japanese Unexamined Utility Model Publication No. 54-134588 and Japanese Unexamined Patent Publication No. 57-170276 disclose, for example, game machines in which a player competes for points which are gained by timingly hitting any of such targets as imitation mice or alligators which are reciprocatingly exposed from their hidden position at a specified interval.

Also. European Patent Publication No. EP-0276136 A2 discloses a game machine in which imitations of mice and cats are arranged on a playing board. In this prior art, a player gives a command to attack an imitation mouse as it emerges in a variety of its reciprocating movement patterns and, if the command timing is appropriate, an imitation cat controlled by a computer program comes up and hits the imitation mouse. A point is added to the player's score if the attack is successful.

These conventional target hitting game machines require a complicated drive mechanism since they all include reciprocally moved targets. Further, their overall construction becomes large due to the need for providing sufficient space to cover reciprocating strokes of the individual targets. In addition, these conventional target hitting game machines are not so fantastically attractive to players since a point is simply added in reward for every successful attack, which offers limited excitation in playing games. In these conventional target hitting game machines, the targets reciprocate between their hidden and exposed positions and, therefore, a player can easily determine whether to strike a particular target depending on whether it can be seen from the player's viewpoint. In other words, these machines do not have so difficulty as to give a sufficient winning enjoyment to the player.

SUMMARY OF THE INVENTION

It is an object of the present invention to provide a target hitting game machine which has overcome the problems residing in the prior art.

It is another object of the present invention to provide a target hitting game machine which has a reduced size.

It is another object of the present invention to provide a target hitting game machine which can provide bonus targets to the player in addition to usual targets.

Accordingly, the present invention is directed to a target hitting game machine comprises: a cover member being formed with an opening; a target having an effective hitting area on a portion of the surface thereof, the target being rotatably disposed in the cover member and partially exposed through the opening during the rotation; a drive mechanism which rotates the target; an exposure detector which detects that the effective hitting area of the target is exposed through the opening; a hit detector which senses that the target is hit by a player; and a successful hitting determinator which is in responsive to the exposure detector and the hit detector and determines a successful hitting that the effective hitting area is hit.

There may be provided a rotary shaft for supporting the target in the cover member. The drive mechanism may be provided with a driver for providing a driving torque to the rotary shaft.

The rotary shaft may be swingably provided in the cover member. The hit detector may be provided with a sensor for sensing a swing of the rotary shaft.

It may be appreciated that the target is in the form of a ball. The effective hitting area may be formed on a half of the surface of the target.

The successful hitting determinator may be provided with an adder for performing mathematical addition to calculate the number of successful hittings, and further provided with a display for displaying a result of the adder.

The cover member may be formed with a plurality of openings. The target, drive mechanism, exposure detector, hit detector, and successful hitting determinator may be provided in the cover member for each opening.

Further, it may be appreciated to form a secondary opening in the cover member, and provide a secondary target and a secondary drive mechanism for moving the secondary target to an emerging position of emerging from the secondary opening from a hiding position of hiding in the cover member, and vice versa. Also, there may be preferably provided a controller for controlling the drive mechanism to expose the effective hitting area of the target when the secondary target is successfully hit.

With thus constructed target hitting game machine, during the time when the target is rotated, the effective hitting area formed on the target is exposed and hidden. The game machine does not require any reciprocating stroke for the target, unlike the conventional game machines. Accordingly, it is possible to provide a small sized target moving mechanism and thus reduce the overall size of the target hitting game machine greatly.

The rotary shaft carrying the target is simply rotated to expose or hide the effective hitting area. Accordingly, the target moving mechanism can be simplified, and the hitting game machine can be produced at reduced costs.

Also, the rotary shaft is supported swingably. The hit detector detects based on a swing of the rotary shaft to detect hitting. Accordingly, the hitting detection can be performed in a simple construction and with high reliability.

The target has the form of a ball. Accordingly, the target can be produced and rotated more easily.

The adder performs mathematical addition to calculate the number of successful hittings. Its result is shown on the display. Accordingly, the player can see a current score promptly.

Further, the provision of a plurality of openings and targets will provide an increased difficulty to the player, thereby ensuring a high pleasant game.

The provision of the secondary target will give the player more chance of successful hitting and additional points, thereby making the target hitting game machine more attractive and exciting.

Other objects, features and advantages of the present invention will become more apparent upon reading the detailed description of the preferred embodiment to follow in conjunction with the accompanying drawings.

DETAILED DESCRIPTION OF THE PREFERRED EMBODIMENT OF THE INVENTION

Figure 1:
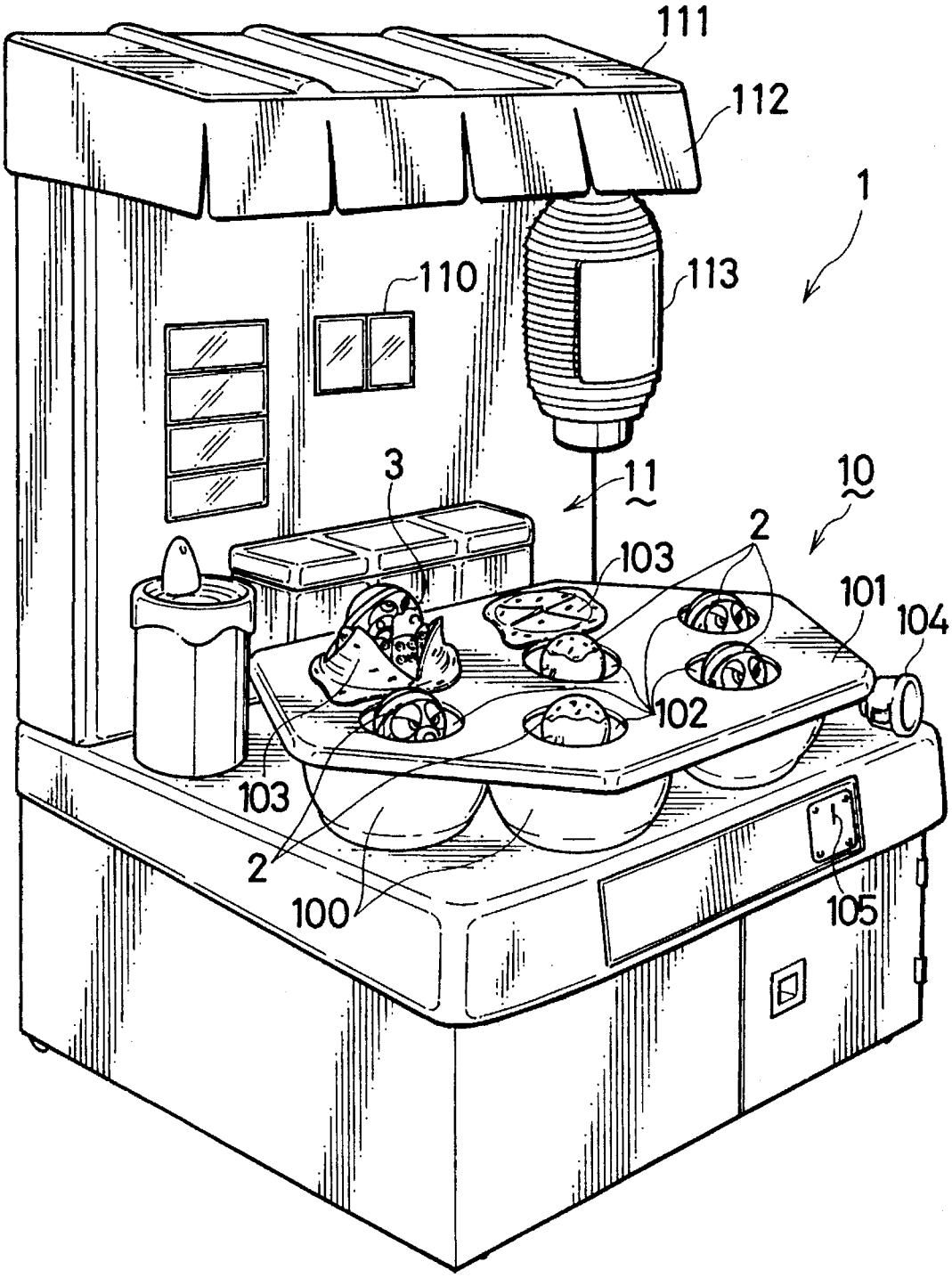
FIG. 1 is a perspective view showing an overall construction of a target hitting game machine embodying the invention.

FIG. 1 is a general external view of a target hitting game machine embodying the invention. The target hitting game machine includes a main unit 1 provided with a base 10 and a display panel 11 vertically mounted on a back of the base 10. The main unit 1 is reminiscent of a takoyaki stand in which a vendor cooks and sells "takoyaki," a Japanese griddled snack made of ball-shaped batter with bits of octopus inside.

Mounted on top of the base 10 is a playing board (cover member) 101 of an appropriate size having a plurality of hemispherical projections 100 formed in a specific arrangement pattern on the underside, resembling as a whole an iron plate used for cooking takoyaki. There are formed openings 102 in the playing board 101 at positions corresponding to the hemispherical projections 100, the number of the openings 102 being seven in this embodiment. The frontal five openings 102 allow spherical objects (or targets) 2 which look like takoyakis to emerge from and hide into the corresponding hemispherical projections 100. The remaining two openings 102 in the back each have a normally closed flexible cover 103 radially cut along their circumferences. The cover 103 resembles not-fried stuffs for takoyaki. Held in these two openings 102 are spherical objects (or bonus targets) 3 imitating dough balls of takoyaki. When a bonus target 3 emerges from under the cover 103 breaking up its split tongues, it appears as if an octopus swelling up from inside the dough ball is peeking out. There is provided a hammer 104 for striking the targets 2 and bonus targets 3 at a front corner of the base 10. The hammer 104 is stored with its handle inserted into a hole in the base 10 when not in use. On the front of the base 10, there is provided a coin slot 105.

The display panel 11 is so constructed as to look like a wall. Approximately at the center of the display panel 11, there is a score display 110 including light emitting diodes (LED's) for numerically presenting a player's score, associated side by side with a sticker showing a table of player achievement levels corresponding to specific ranges of score. Extending forward from the top of the display panel 11 are eaves 111 with a shop curtain 112 and a lantern 113 hanging from the eaves 111. There are also provided cans of imitation sauce and dried seaweed that are normally used for topping takoyaki. All this arrangement is to give a realistic image of a takoyaki stand.

Inside the base 10 and hemispherical projections 100, there are incorporated a mechanism for causing the individual targets 2 and bonus targets 3 to emerge from and hide into the openings 102 in the playing board 101 as well as a controller which controls the progress of a game in accordance with target behaviors and detected player actions.

Construction of the targets 2 and bonus targets 3 and their appearance/disappearance mechanisms will be described in the following.

Figure 2:
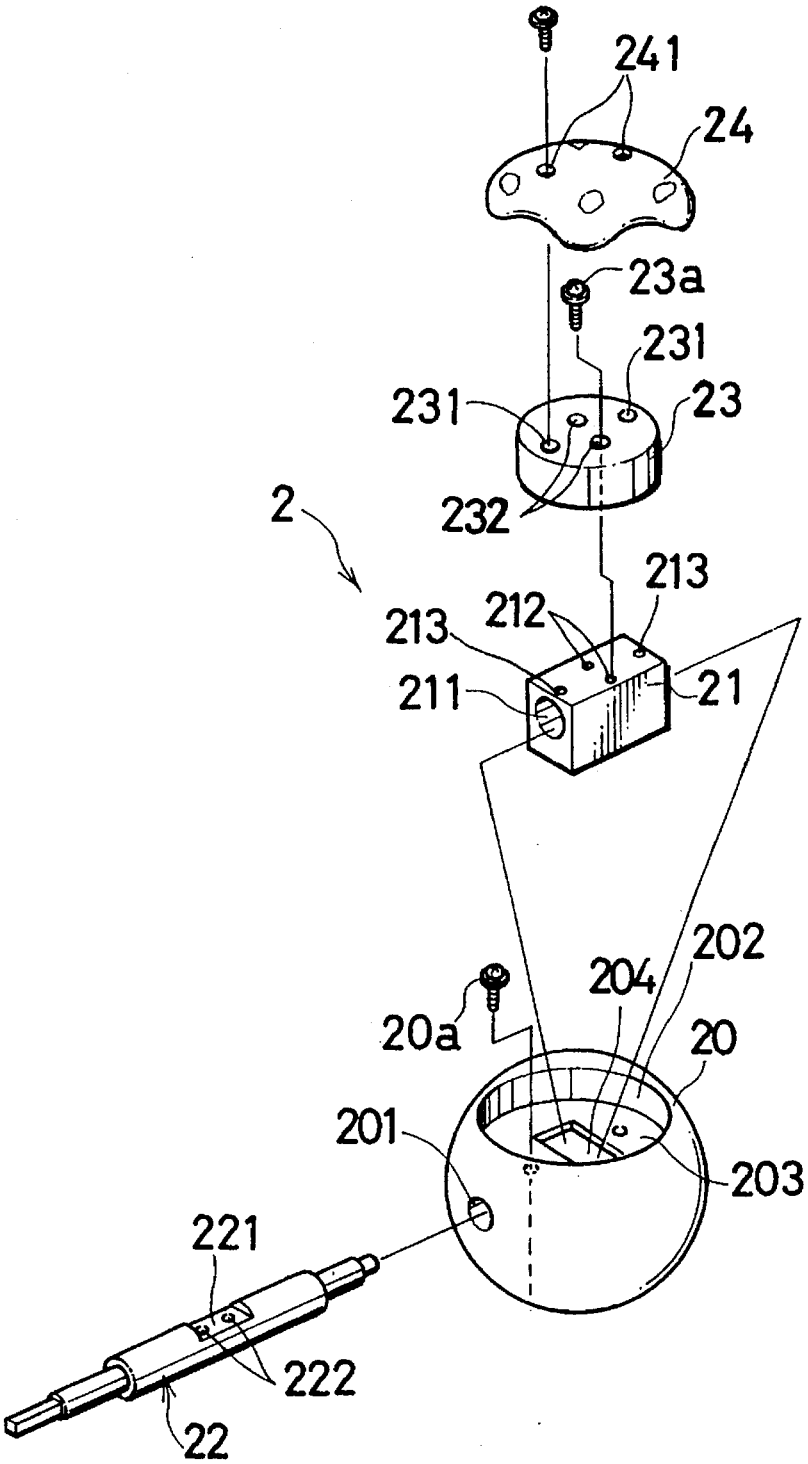
FIG. 2 is an exploded perspective view showing a construction of each target provided in the machine.
Figure 3:
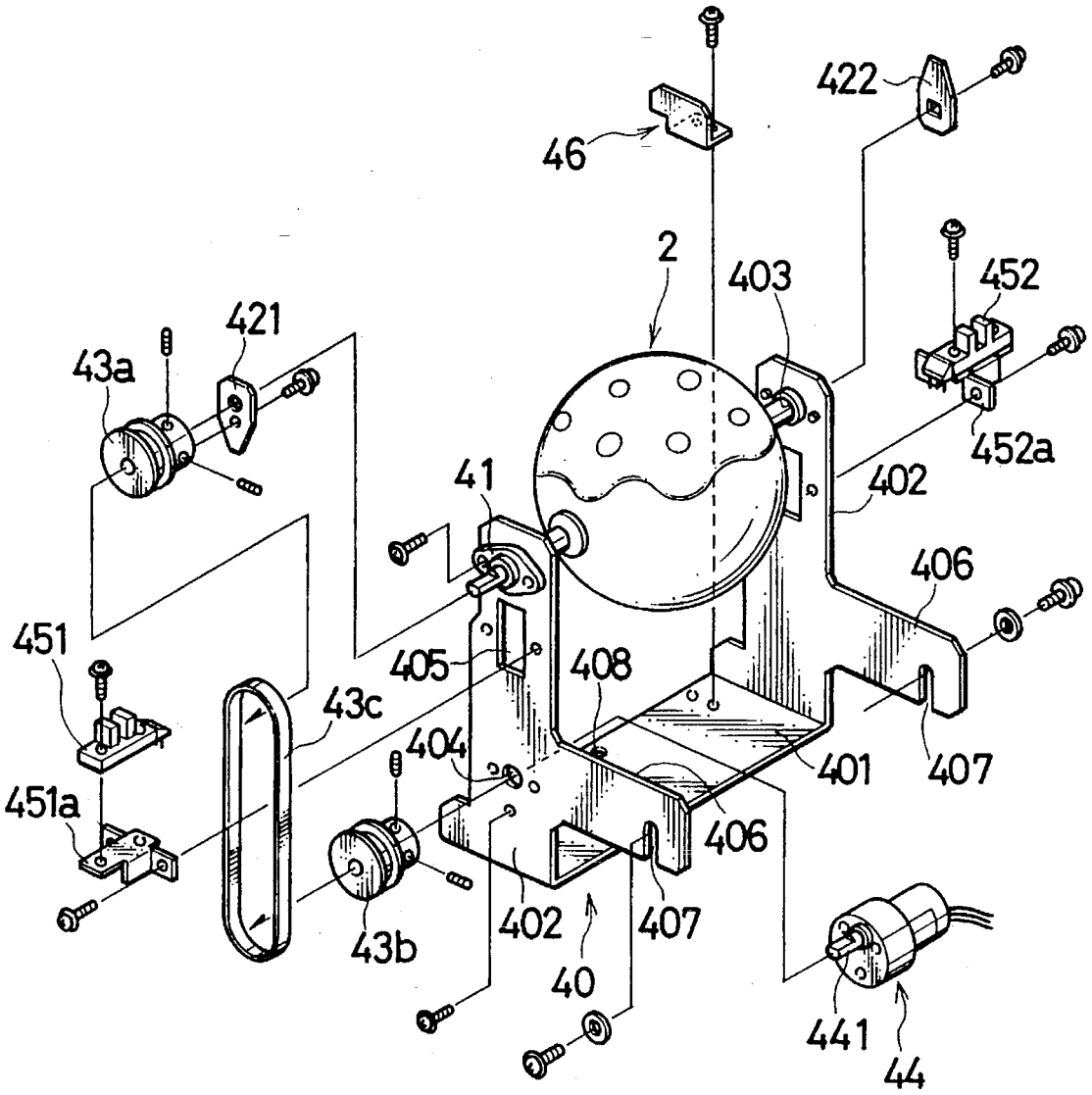
FIG. 3 is an exploded perspective view showing a construction of a target support assembly provided in the machine.
Figure 4:
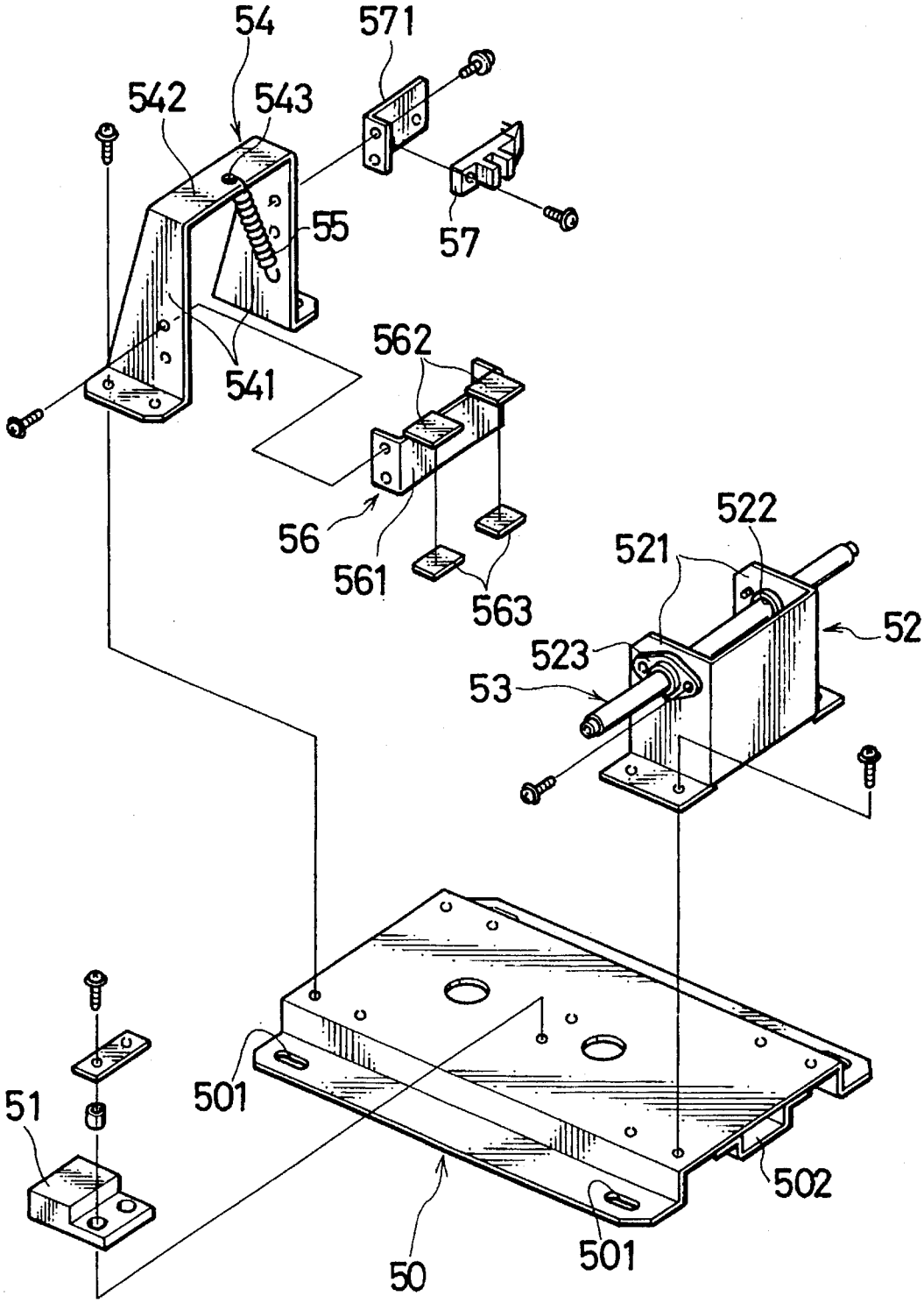
FIG. 4 is an exploded perspective view showing a construction of a rocking cradle assembly provided in the machine.
Figure 5:
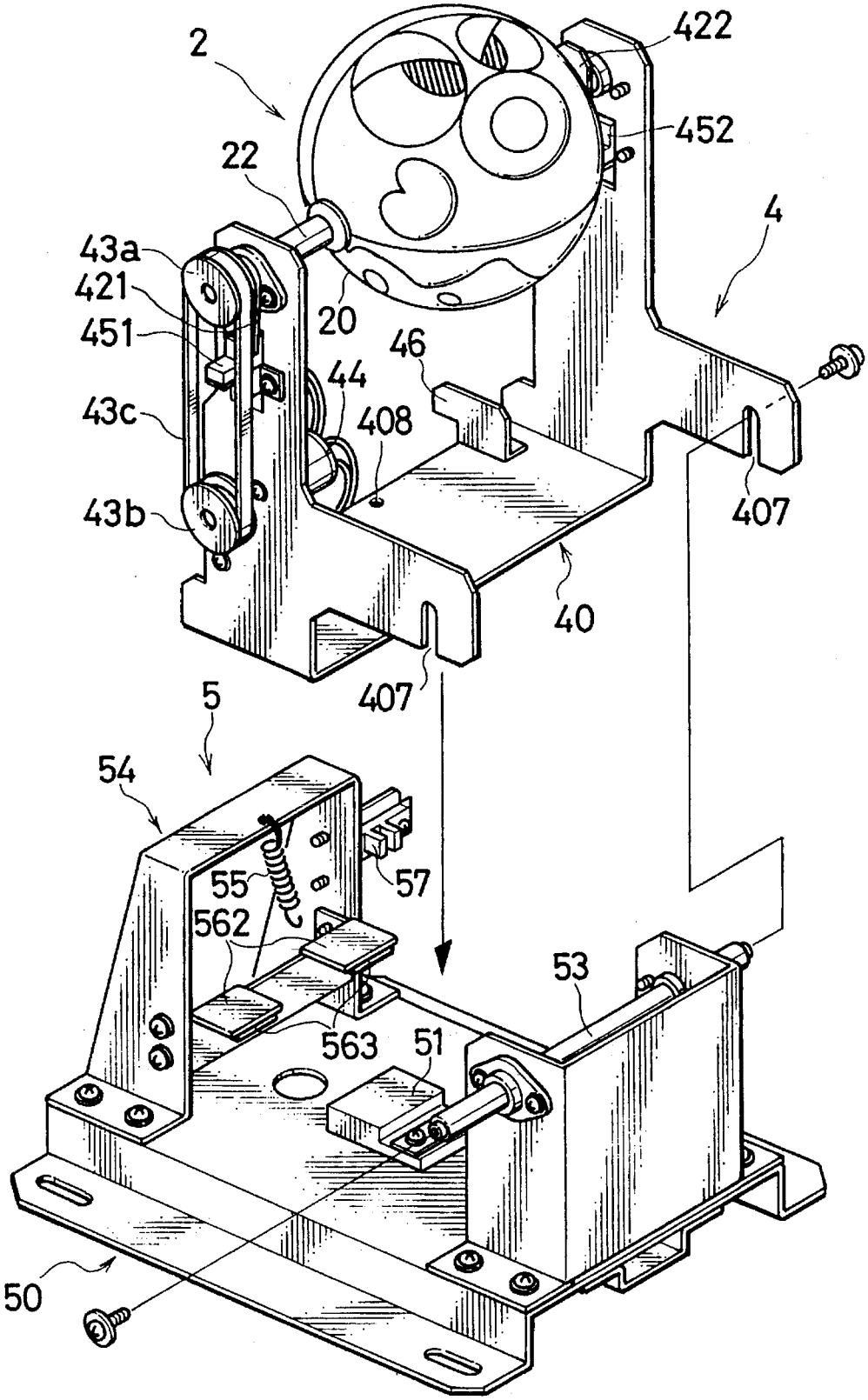
FIG. 5 is a perspective view depicting assembling of a target unit.
Figure 6:
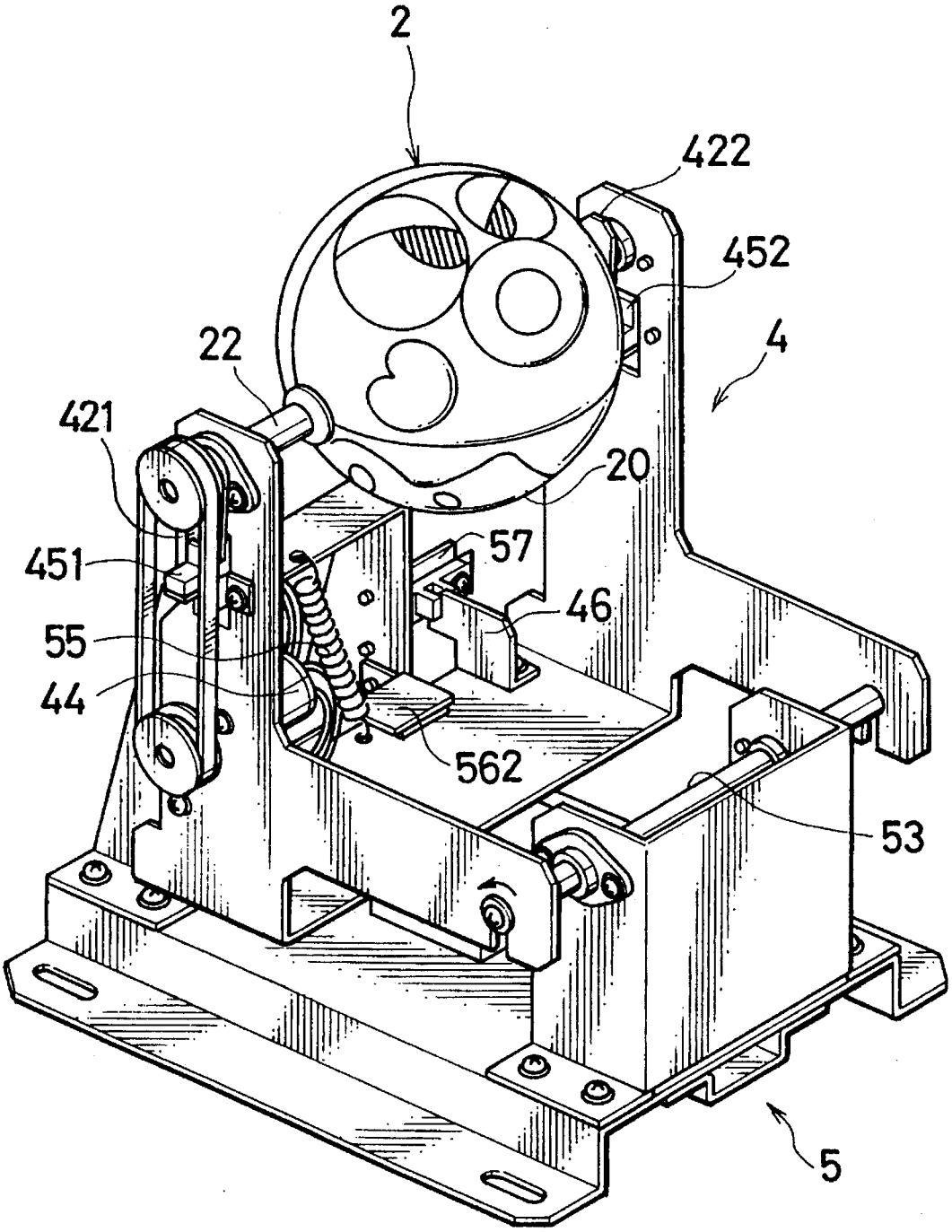
FIG. 6 is a perspective view showing a fully assembled target unit.

FIGS. 2 to 6 illustrate a construction of the targets 2 and their appearance/disappearance mechanisms. FIG. 2 is an exploded perspective view of each target 2; FIG. 3 is an exploded perspective view of a target support assembly 4; FIG. 4 is an exploded perspective view of a rocking cradle assembly 5; FIG. 5 is a perspective view depicting how a target unit is assembled; and FIG. 6 is a perspective view showing a fully assembled target unit. As shown in FIG. 5, each target unit 2 includes the target support assembly 4 and rocking cradle assembly 5.

Referring to FIG. 2, the construction of the target 2 is now described. Each target 2 includes a hollow spherical body 20 having shaft holes 201, into which a rotary shaft 22 is inserted passing through the center of the spherical body 20. The spherical body 20 has an opening 202 cut in a plane perpendicular to the shaft holes 201. In this embodiment, the surface of the spherical body 20 is divided into two hemispherical areas by a circle passing through the shaft holes 201, and the two hemispherical areas have different designs. As an example, the lower half (as shown in FIG. 2) of the spherical body 20 carries a picture representative of an effective hitting area (e.g., a facial image of octopus as shown in FIG. 5) a successful hitting on which is awarded a point while the outer surface of a cap 24 mounted on the upper half of the spherical body 20 carries a picture representative of a mishit area (e.g., dough of takoyaki). It is to be noted that the pictures shown on the effective hitting area and mishit area of the spherical body 20 are not limited to those of an octopus but any other images may be used.

Inside the opening 202 of the spherical body 20, there is provided an internal plate 203 which is formed as an integral part of the spherical body 20 or as a separate element conjoined with the spherical body 20, and a cutout 204 of a specified size is formed in the middle of the internal plate 203.

The spherical body 20 contains a fixing block 21 formed in the shape of a rectangular parallelepiped. The fixing block 21 has a through hole 211 which runs from one side to the opposite side of the fixing block 21. On the top surface of the fixing block 21, there are two screw holes 212 aligned in a direction perpendicular to the axis of the through hole 211 as well as two fixing holes 213 drilled just above the through hole 211 aligned in its axial direction all the way down to the inner surface of the through hole 211. The rotary shaft 22 has a flat portion 221 formed on its cylindrical surface approximately in the middle of its axial length. In the flat portion 221, two screw holes 222 are formed in a direction perpendicular to an axis of the through hole 211. After the fixing block 21 is accommodated underneath the internal plate 203 in the spherical body 20, the rotary shaft 22 is inserted into the shaft holes 201 and through hole 211, and two screws 20*a* passed from the topside of the internal plate 203 through the fixing holes 213 in the fixing block 21 down to the flat portion 221 of the rotary shaft 22 are tightened into the screw holes 222 in the flat portion 221. In this way, the fixing block 21 and rotary shaft 22 are attached to the spherical body 20.

In FIG. 2, indicated at numeral 23 is a disk member formed in a cylindrical shape. Two each screw holes 231 and fixing holes 232 symmetrically arranged with respect to the axial center of the disk member 23 pass from its one end surface to the other. Two screws 23*a* are passed through the fixing holes 232 and internal plate 203, and screwed into the screw holes 212 in the fixing block 21 to secure the disk member 23 to the spherical body 20.

Two screw holes 241 are formed in the cap 24. A pair of screws are passed through these screw holes 241 and tightened into the screw holes 231 in the disk member 23 to secure the cad 24 to the spherical body 20.

Referring now to FIGS. 3 and 5, the construction of each target support assembly 4 for rotatably supporting a target 2 is described in detail. The target support assembly 4 includes a bracket 40 which is generally formed by bending upward the left and right portions of a flat plate. More specifically, the target support assembly 4 has a bottom plate 401 and symmetrically formed left and right upright plates 402. The individual upright plates 402 have shaft holes 403 at upper positions facing each other. A pair of bearings 41 are screwed to the upright plates 402 just at the positions of the shaft holes 403 to rotatably support the rotary shaft 22.

The axial length of the rotary shaft 22 is such that its both end portions slightly protrude from the outside surfaces of the bearings 41. As shown in FIG. 3, a detecting tab 421 having a projecting part in a radial direction and a pulley 43*a* mated together are rotatably mounted on the left-hand protruding portion of the rotary shaft 22. Another detecting tab 422 having the same shape as the left-hand detecting tab 421 is rotatably attached to the right-hand protruding portion of the rotary shaft 22, with a mutual phase difference (or angular deviation) of 180 degrees. The left-hand upright plate 402 has a hole 404 in its middle or lower position, and a motor 44 is mounted on the inside of the upright plate 402 with its drive shaft 441 passing through the hole 404 from inside. With a pulley 43*b* mounted on the drive shaft 441 of the motor 44, a belt 43*c* is passed around the pulleys 43*a* and 43*b*. When the motor 44 is activated, rotary motion is transmitted from its drive shaft 441 to the rotary shaft 22 by way of the pulley 43*b*, belt 43*c* and pulley 43*a*, eventually causing the target 2 to rotate.

Immediately below the shaft hole 403 into which the left end of the rotary shaft 22 is fitted, there is formed a rectangular cutout 405, where an initial position sensor 451 including a photosensor element is attached by a sensor bracket 451*a*. The initial position sensor 451 includes a light emitter and a receiver arranged face to face with a specified gap so that the projecting part of the detecting tab 421 passes therebetween. The right-hand upright plate 402 also has a similar arrangement, in which an end position sensor 452 including a photosensor element is attached by a sensor bracket 452*a* and the projecting part of the detecting tab 422 passes through the gap between a light emitter and a receiver.

The initial position sensor 451 and the end position sensor 452 are adapted for detecting the rotational position of the target 2. When the detecting tab 421 is located at a position where it is detected by the initial position sensor 451, the motor 44 is driven in its forward direction until the end position sensor 452 detects the detecting tab 422. On the other hand, when the detecting tab 422 is located at a position where it is detected by the end position sensor 52, the motor 44 is driven in its reverse direction until the initial position sensor 451 detects the detecting tab 11. The motor 44 is alternately driven in its forward and reverse directions depending on detecting results of the initial position sensor 451 and end position sensor 452. As will be later described in more detail, hitting at the target 2 during forward driving of the motor 44 is regarded as a success while hitting during reverse driving of the motor 44 is handled as a miss.

Indicated at numeral 46 is a detecting tab which allows detection of rocking motion of the target support assembly 4. The detecting tab 46 is mounted in the back (left side in FIG. 3) of the bottom plate 401, partially projecting from its rear edge.

There is formed a flat support arm 406 extending forward from the front edge of each upright plate 402. Each support arm 406 has an inverted-U-shaped slot 407 cut out on its lower edge.

Referring now to FIGS. 4 and 5, the construction of each rocking cradle assembly 5 is described in detail. The rocking cradle assembly 5 includes a base plate 50 of which left and right marginal portions are bent stepwise to form mounting flanges. There are provided oval-shaped fixing holes 501 at the four corners of the mounting flanges. Although the fixing holes 501 may be round holes, oval-shaped holes are preferable since the latter facilitate adjustment of the mounting position. Indicated at numeral 502 is a reinforcing plate having a U-shaped cross section. A stopper rubber block 51 is screwed or otherwise attached in approximately the middle of the topside of the base plate 50. Formed in approximately a rectangular shape, the stopper rubber block 51 serves as a shock absorber between the target support assembly 4 and base plate 50 when the former is in rocking motion.

On the front topside of the base plate 50, there is screwed a rocking shaft support 52 including left and right bent plate portions 521 arranged face to face, having generally a U-shaped top view. The left and right bent plate portions 521 individually have holes 522 facing each other, in which a pair of bearings 523 are mounted. A long-sized rocking shaft 53 is securely attached or pivotably fitted into these bearings 523 with both end portions of the rocking shaft 53 protruding from the outside surfaces of the bearings 523. The target support assembly 4 mounts on the rocking cradle assembly 5 with the aforementioned inverted-U-shaped slots 407 hooking on the projecting end portions of the rocking shaft 53.

On the rear topside of the base plate 50, there is mounted a suspension support 54 including a pair of upright legs 541 formed by bending down both left and right portions of a flat plate in a symmetrical pattern and fixing flanges having screw holes formed at extreme end portions of the plate. Approximately at the middle position of a horizontal top portion 542 of the suspension support 54, there is formed a spring attachment hole 543. Another spring attachment hole 408 is formed at a rear central position of the bottom plate 401 of the bracket 40. As a spring 55 is mounted between the spring attachment hole 543 and spring attachment hole 408, the target support assembly 4 is suspended rotatably about the axis of the rocking shaft 53 with the rear side of the target support assembly 4 held in a position slightly raised from the topside of the base plate 50.

In FIG. 4, indicated at numeral 56 is a stopper including a lower portion 561 formed in the shape of the letter "U" as viewed from top, a pair of stopper tabs 562 extending forward from the upper edge of the lower portion 561 and a pair of shock-absorbing sponge rubber pads 563 adhered to the underside of the stopper tabs 562. Mounted between the upright legs 541 of the suspension support 54, the stopper 56 restrains the target 2 below a position where it is partly exposed through the relevant opening 102. When a target 2 is hit, the target support assembly 4 is forced downward and its bottom plate 401 bumps against the base plate 50. Then, pulled by the spring 55, the bottom plate 401 returns to its raised position. The stopper 56 alleviates shocks that occur as the topside of the bottom plate 401 hits against the sponge rubber pads 563 at the end of its upward motion. As previously mentioned, shocks due to a collision between the bottom plate 401 and base plate 50 are lessened by the stopper rubber block 51.

At an appropriate outside position on one of the upright legs 541, there is attached a sensor bracket 571 to which an optical hit sensor 57 is mounted. The hit sensor 57 includes a light emitter and a receiver facing each other with a specified gap therebetween. When the target 2 is hit and the target support assembly 4 is caused to swing down against the compressive force of the spring 55 as shown in FIG. 6, the detecting tab 46 of the target support assembly 4 goes in between the light emitter and receiver of the hit sensor 57. Rocking motion of the target 2 is detected as the light path between the light emitter and receiver is interrupted at this point. A resultant detection signal outputted from the hit sensor 57 is used to recognize a successful hit should the motor 44 is in a forward driving condition.

Figure 7:
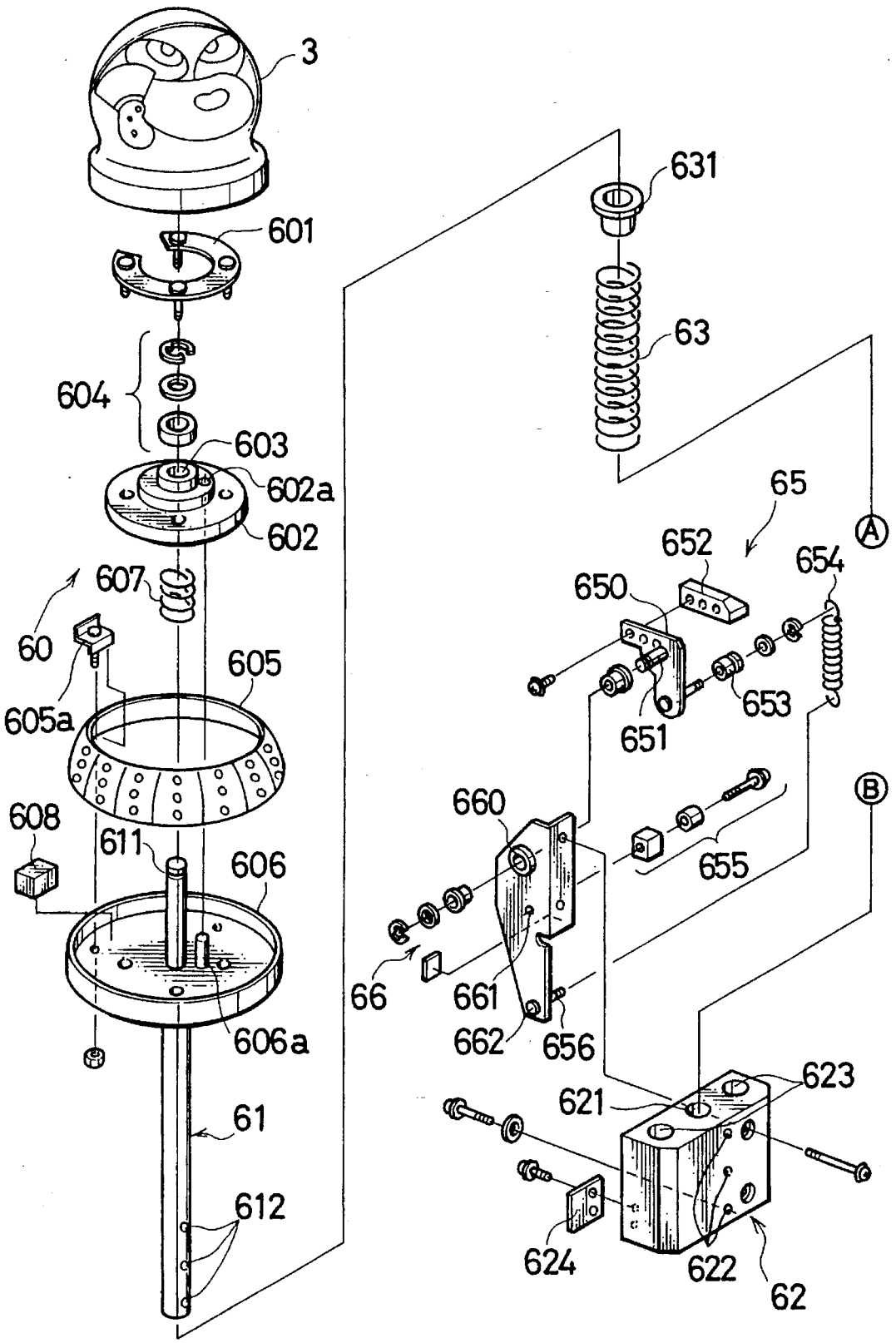
FIG. 7 is an exploded perspective view showing a construction of a bonus target support assembly provided in the machine.
Figure 8:
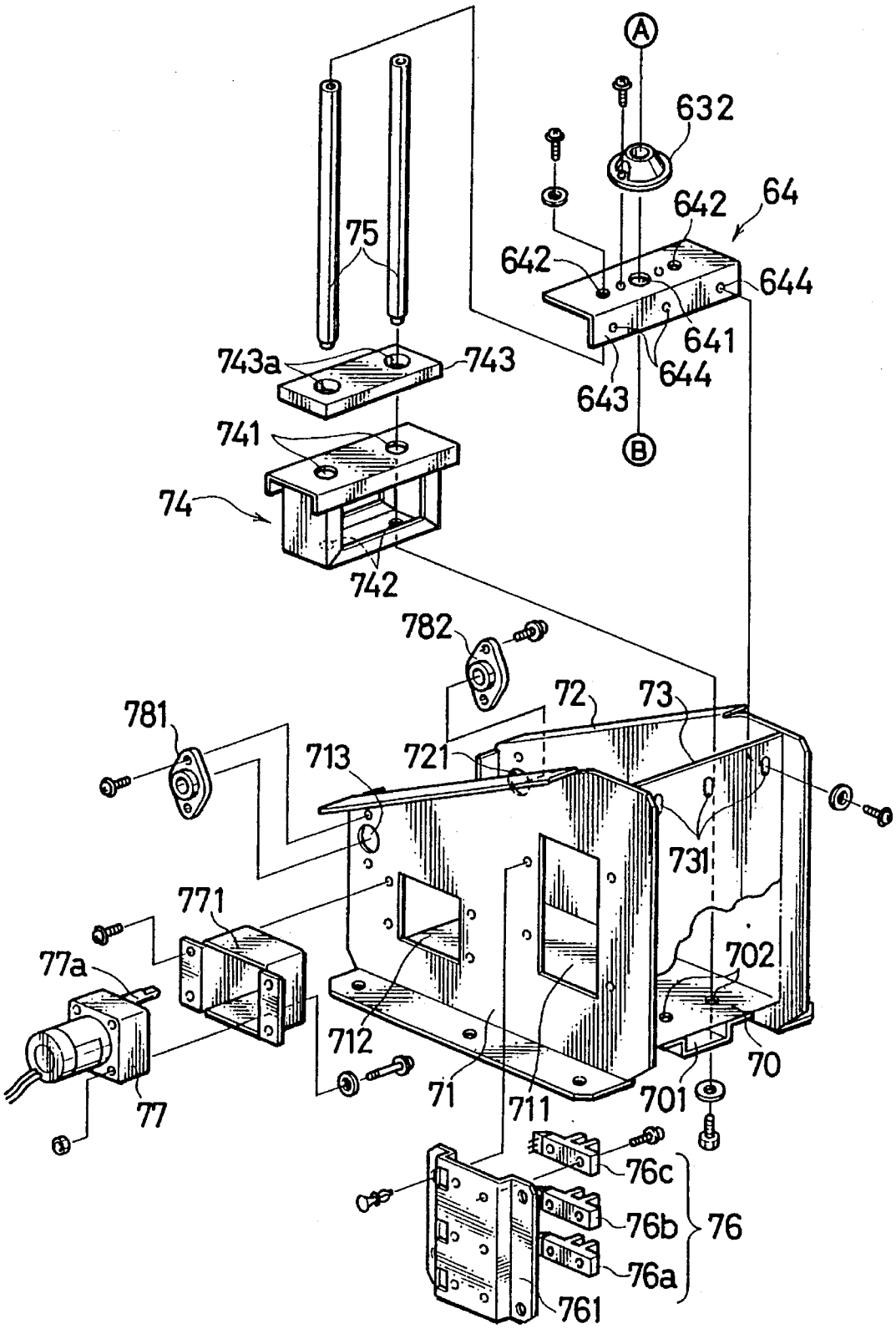
FIG. 8 is an exploded perspective view showing a part of the bonus target support assembly and an elevating bracket assembly.
Figure 9:
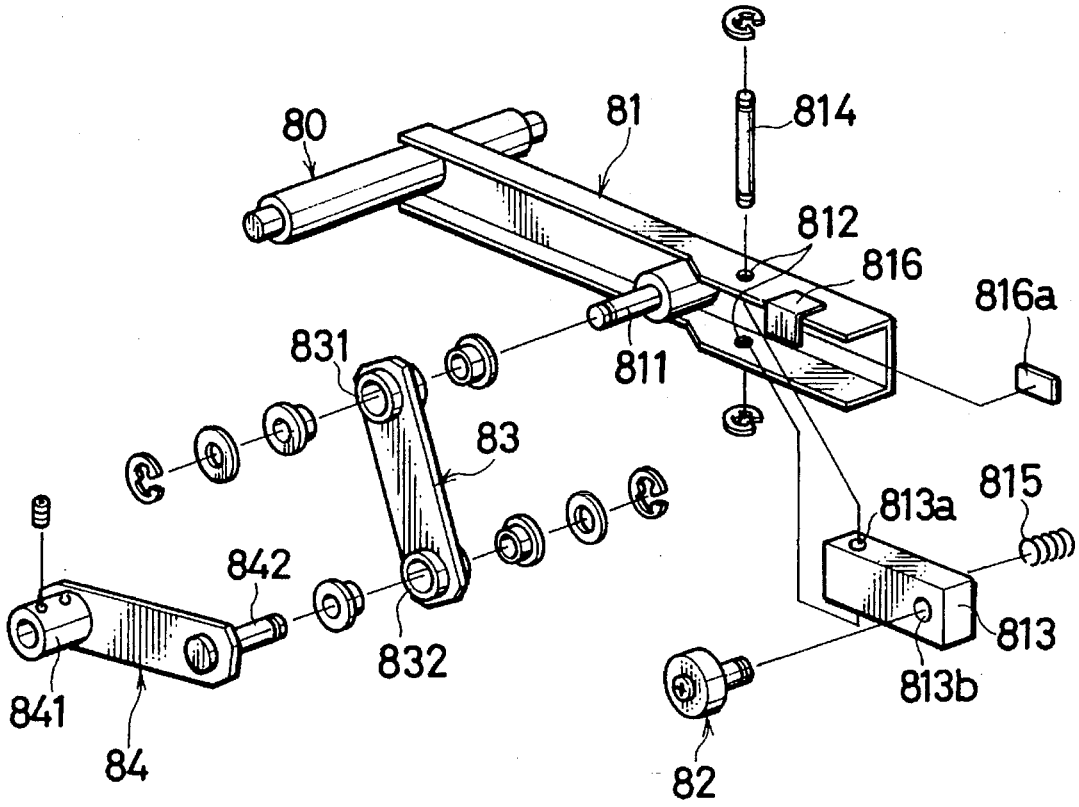
FIG. 9 is an exploded perspective view showing a construction of an elevating crank mechanism.
Figure 10:
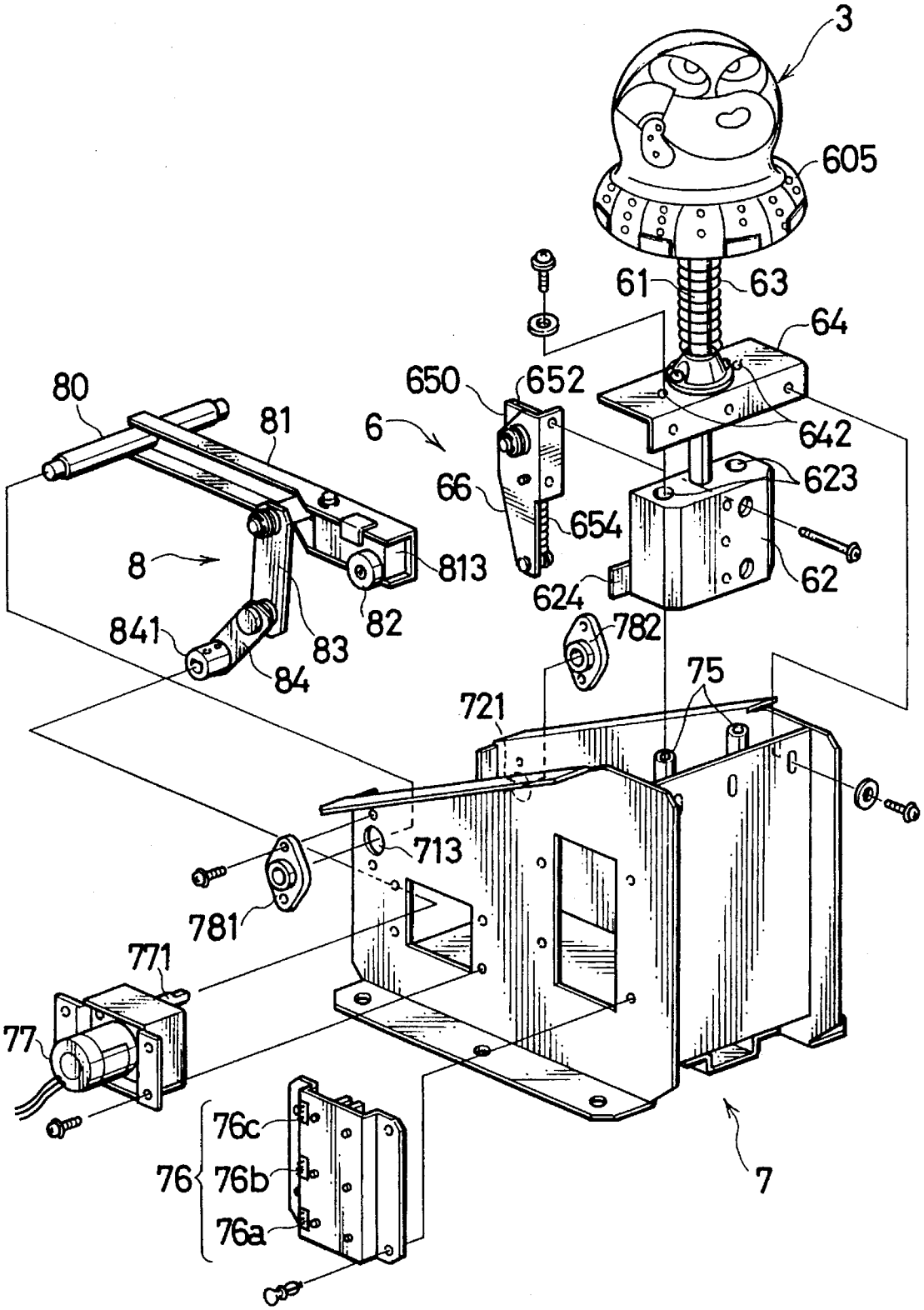
FIG. 10 is a perspective view depicting assembling of a bonus target unit.
Figure 11:
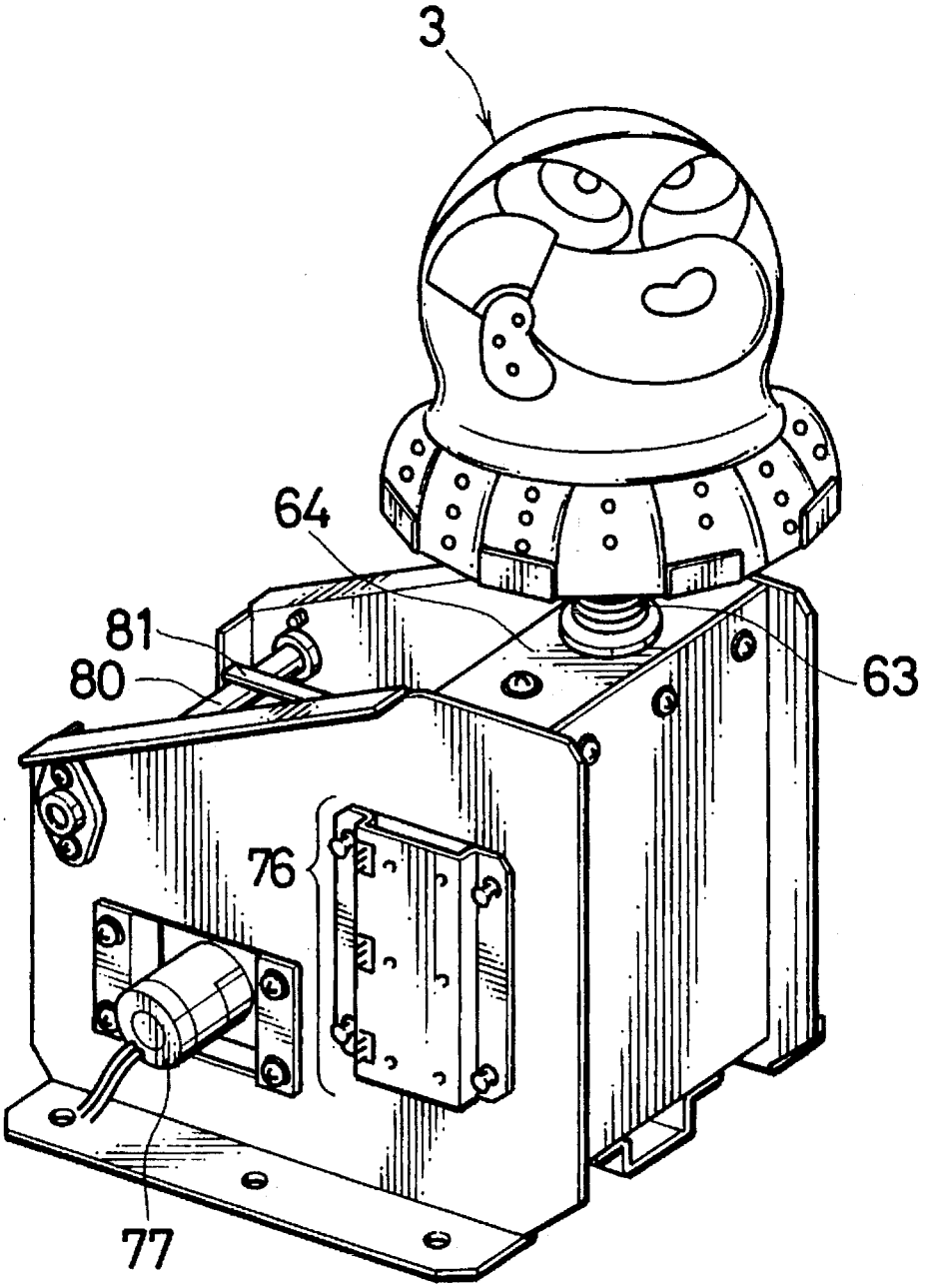
FIG. 11 is a perspective view showing a fully assembled bonus target unit.

FIGS. 7 to 11 illustrate the construction of each bonus target 3 and its appearance/disappearance mechanism. FIG. 7 is an exploded perspective view of a bonus target support assembly 6; FIG. 8 is an exploded perspective view showing part of the bonus target support assembly 6 and an elevating bracket assembly 7; FIG. 9 is an exploded perspective view of an elevating crank mechanism 8; FIG. 10 is a perspective view depicting how a bonus target unit is assembled; and FIG. 11 is a perspective view showing a fully assembled bonus target unit. Each bonus target unit includes a bonus target support assembly 6, an elevating bracket assembly 7 and an elevating crank mechanism 8.

Referring to FIG. 7 and part of FIG. 8, the construction of the bonus target support assembly 6 is now described. Each bonus target 3 has its support assembly 6 underneath. The support assembly 6 essentially includes a holder section 60 on which the bonus target 3 is mounted, a long-sized shaft 61 of which upper end is connected to the holder section 60, a slide block 62 mounted to the lower end of the shaft 61 and a slide stopper 65 attached to the slide block 62. The shaft 61 has a smaller diameter over a specified length from its upper end compared to the remaining portion thereof.

The holder section 60 includes a generally ring-shaped holder 601 attached to the bottom of the bonus target 3 with a plurality of bolts projecting downward. The holder 601 is mounted on top of a disklike holder base 602 and fastened by nuts. The holder base 602 has a through hole 603 at the center. The shaft 61 is passed through this hole 603 and is locked to prevent the holder base 602 from coming off by means of a retaining ring or like retaining members 604 fitted into a circumferential groove 611 formed close to the upper end of the shaft 61. Provided underneath the holder base 602 are a generally ring-shaped covering member 605 and a saucer-like circular support 606 which is held at the lower limit position of the smaller diameter portion of the shaft 61. There are provided a plurality of retainers **605*a* along the circumference of the circular support 606. These retainers 605*a* clamp the external surface of the covering member 605 along its circumference so that the covering member 605 is secured to the support 606**.

The holder base 602 has an eccentric hole **602*a* while the support 606 has a pin 606*a* protruding upward at a position corresponding to the hole 602*a*. When the holder base 602 is mounted on the support 606, the pin 606*a* fits into the hole 602*a* so that the bonus target 3 does not turn around the shaft 61 when hit by the player. A coil spring 607 is mounted over the shaft 61 just between the holder base 602 and support 606 so that the bonus target 3 slightly vibrates up and down with respect to the support 606 when hit by the player. Indicated at numeral 608 is a sponge rubber pad for absorbing shocks which occur when the bonus target 3 is hit and the holder base 602 bumps against the support 606**.

A coil spring 63 associated with upper and lower spring guides 631, 632 is mounted over the shaft 61 just between the support 606 and the slide block 62. The lower spring guide 632 is screwed to a shaft holder 64 in which a through hole 641 for slidably passing the shaft 61 is formed as shown in FIG. 8. Having a pair of screw holes 642 on both sides of the through hole 641, the shaft holder 64 is screwed to the upper ends of a pair of slide shafts 75 by the screw holes 642 as will be further discussed later, the slide shafts 75 being hollow cylindrical members having female screw threads cut on their internal surfaces at least at their upper and lower portions. The shaft holder 64 also has at its front side a bent upright flange 643 in which a plurality of screw holes 644 are tapped. These screw holes 644 are for fixing the shaft holder 64 to a front plate 73 of the elevating bracket assembly 7. In this way, each individual bonus target 3 is made movable up and down relative to the shaft holder 64.

The slide block 62 is formed generally in the shape of a rectangular parallelepiped with a through hole (or a hole with a closed bottom) 621 passing its central vertical axis. The slide block 62 is further provided with a plurality of screw holes 622 vertically arranged on a sidewall. There are also formed the same number of holes 612 on the shaft 61 aligned in its axial direction at the same intervals as the screw holes 622. The shaft 61 and slide block 62 are connected together by tightening screws from the slide block 62 through the screw holes 622. The slide block 62 also has a pair of slide holes 623 of a specified diameter passing in parallel with the through hole 621 on its both sides. The slide shafts 75 to be later described are slidably passed through the slide holes 623. A vertical detecting tab 624 projecting leftward for detecting up/down motion of the slide block 62 is attached to an appropriate position on its sidewall.

The slide stopper 65 is attached to a bracket 66 which is screwed to the slide block 62. The bracket 66 has an upright sidewall provided with a shaft hole 660 at a higher position where a link member 650 is rotatably fitted, a small hole 661 at a middle-height position where a stopper 655 is attached, and a small hole 662 at a lower position where a hook 656 is attached.

Formed in the shape of the letter "L", the link member 650 has a pivot 651 horizontally projecting from approximately the middle of the "L" shape. With the pivot 651 fitted into the shaft hole 660, the link member 650 is mounted on the bracket 66 rotatably in a vertical plane. There is secured a contact block 652 on the right side of one straight portion (upper side in FIG. 7) of the link member 650 while a hook 653 is attached to the tip of the other straight portion of the link member 650. The contact block 652 has a narrow top surface and a widened bottom surface, each being parallel to the opposite surface, with a sloping surface formed between the top and bottom surfaces. As a spring 654 is mounted between the hook 653 and hook 656, the link member 650 is pulled in the clockwise direction about the pivot 651 so that the contact face of the contact block 652 is normally held in a horizontal position.

The construction of the elevating bracket assembly 7 is now described referring to FIG. 8. The elevating bracket assembly 7 has a framework mainly composed of a rectangular bottom plate 70, left-hand and right-hand side plates 71, 72, and the earlier-mentioned front plate 73. A reinforcing member 701 having a U-shaped frontal cross section is attached to the underside of the bottom plate 70 to strengthen it.

At the front of the bottom plate 70, there are provided two through holes 702 on the left and right sides, on which a stopper base 74 is attached. The stopper base 74 includes a top plate, bottom plate, and side plates. The stopper base 74 is formed generally into the shape of a rectangular parallelepiped. The top and bottom plates have pairs of through holes 741 and 742, respectively, at positions corresponding to the through holes 702 in the bottom plate 70. A sponge rubber pad 743 having a specified thickness for absorber is adhered or attached to the top plate of the stopper base 74. The sponge rubber pad 743 also has a pair of through holes 743*a* at positions corresponding to the through holes 741 and 742. As previously mentioned, the two slide shafts 75 are hollow cylindrical members having female screw threads cut on their internal surfaces at least at their upper and lower portions. The slide shafts 75 are individually passed through the through holes 743*a*, 741, 742 and 702 as well as a pair of through holes (invisible in FIG. 8) formed in mounting flanges of the reinforcing member 701. The slide shafts 75 are then secured to the bottom plate 70 by tightening screws into their lower ends from under the reinforcing member 701. On the other hand, there are formed a plurality of holes 731 along the upper edge of the front plate 73 at positions corresponding to the screw holes 644 in the shaft holder 64. The shaft holder 64 is attached to the front plate 73 by tightening screws through the holes 731. In this way, the slide shafts 75 are held by the shaft holder 64 and bottom plate 70 in the upright position.

The slide block 62 is mounted on the slide shafts 75 with the slide shafts 75 passed through the two slide holes 623, allowing the slide block 62 to slide up and down along the slide shafts 75.

Figure 12:
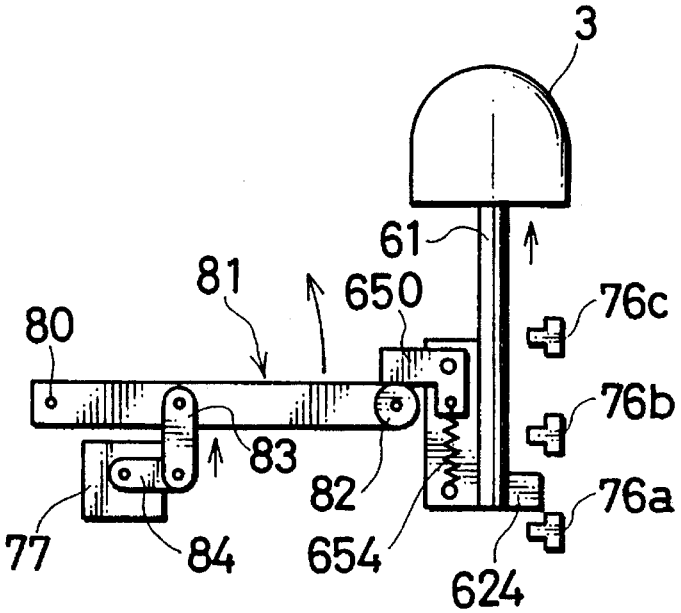
FIG. 12 is a diagram showing an appearance and disappearance operation of a bonus target, the bonus target being at a lowermost initial position up to a point immediately after the start of an ascending motion.

In the vertical section of the side plate 71 on the left, there is made a cutout 711 at a position where the slide shafts 75 are exposed. A sensor bracket 761 carrying three photosensors 76 is screwed over the cutout 711. The three photosensors 76 are attached to the inside surface of the sensor bracket 761 at specified intervals in a vertical direction. The three photosensors 76 are, from bottom to top, an initial position sensor 76*a*, a hit sensor 76*b* and an end position sensor 76*c*, as shown in FIG. 12. Each of the photosensors 76 has a light emitter and a receiver horizontally separated from each other with a specified gap therebetween. When the slide block 62 is positioned at a specific height, the detecting tab 624 attached to the slide block 62 interrupts the light path between the light emitter and receiver of a particular photosensor 76. It could be recognized from the above discussion that the three photosensors 76 serve to determine the height of the slide block 62.

Approximately in the middle of the side plate 71, there is provide another cutout 712, where a motor retainer 771 carrying a motor 77 is secured by screws with the motor retainer 771 fitted into the cutout 712 projecting above the bottom plate 70. As will be discussed later, the motor 77 is for driving the elevating crank mechanism 8 and its rotary shaft 77*a* protrudes above the bottom plate 70.

Further, the side plate 71 is formed with a shaft hole 713 in a rear portion thereof. A bearing 781 is attached to the shaft hole 713. Similarly, the side plate 72 is formed with a shaft hole 721 in a rear portion thereof corresponding to the shaft hole 713. A bearing 782 is attached to the shaft hole 721.

Referring now to FIG. 9, the construction of the elevating crank mechanism 8 is described. The elevating crank mechanism 8 mainly includes a shaft 80, an arm 81, a contact roller 82, a link rod 83 and a crank rod 84. Fitted into the bearings 781 and 782 attached to the shaft holes 713 and 721 in the side plates 71 and 72, respectively, the shaft 80 is rotatably supported at its both ends. The arm 81 is an elongate plate member of a specified length having a U-shaped cross section. One end of the arm 81 is mounted to the shaft 80 at right angles so that the arm 81 can swing about the axis of the shaft 80. Approximately half way along the length of the arm 81, there is attached a pivot pin 811 projecting to the left in parallel with the shaft 80. There are holes 812 in the top and bottom sides of the arm 81 at positions facing each other slightly toward the front end of the arm 81 than the pivot pin 811. A support block 813 is formed into a shape fittable in an inner space of the arm 81 and is formed with a vertical through hole 813*a*. Near the front end of the arm 81, the support block 813 is fitted between the top and bottom sides of the arm 81. The support block 813 is mounted swingably in a horizontal plane about a pin 814 passed through the holes 812 and through hole 813*a*. The support block 813 has a through hole 813*b* passing horizontally from one side to the opposite side, and the earlier mentioned contact roller 82 is rotatably mounted with its shaft fitted into the through hole 813*b*. The contact roller 82 comes in contact with the contact block 652 of the slide stopper 65 from bottom or top side.

The support block 813 is made narrower in the left-to-right direction than the width of the top and bottom sides of the arm 81 and a spring 815 is fitted inside the U-shaped cross section of the arm 81, just between the right side of the support block 813 and the vertical portion of the arm 81. A stopper 816 is attached to an outside surface of a top portion of the arm 81. In this way, the support block 813 is slightly swingable about the pin 814 together with the contact roller 82. On the other hand, the contact block 652 of the slide stopper 65 has a sloping surface on the right side. When the contact roller 82 is pressed against the contact block 652 from topside with a force of a certain level or over, the contact roller 82 horizontally swings along the sloping right-hand surface of the contact block 652 so that the contact roller 82 can easily slip over the contact block 652 even if the link member 650 does not fully turns. As an alternative, the aforesaid horizontal swing mechanism of the contact roller 82 may be eliminated to simplify the construction. In this case, the contact roller 82 goes over the contact block 652 with only the turning motion of the link member 650 about its pivot 651.

The link rod 83 is supported by a pivot hole 831 at its upper end rotatably about the pivot pin 811. The link rod 83 has another pivot hole 832 at its lower end to which the crank rod 84 is mounted. The crank rod 84 has at its one end a hollow cylindrical attachment 841 which is mounted on the rotary shaft 77*a* of the motor 77. At the other end of the crank rod 84, there is attached a pivot pin 842 which is fitted into the pivot hole 832 of the link rod 83. This arrangement allows the crank rod 84 to swing in a plane parallel to the link rod 83.

Thus constructed elevating crank mechanism 8 is mounted in the elevating bracket assembly 7 with the shaft 80 fitted into the bearings 781 and 782. When the motor 77 rotates, the arm 81 is swung about the shaft 80 by the crank rod 84 and link rod 83. As a result, the contact roller 82 pushes up the contact block 652 from its underside for raising the bonus target 3 to its hittable position or runs over the contact block 652 from its top side to bottom side so that the bonus target 3 returns to its initial position.

The appearance/disappearance operation of each bonus target 3 is now described referring to FIGS. 12 to 15. As already mentioned, the initial position sensor 76*a* detects the bonus target 3 when it is in its lowermost position; the hit sensor 76*b* enables detection of a hitting action at and actually detects it; and the end position sensor 76*c* stops the motor 77 upon confirming that the bonus target 3 has come to its fully exposed position.

Figure 13:
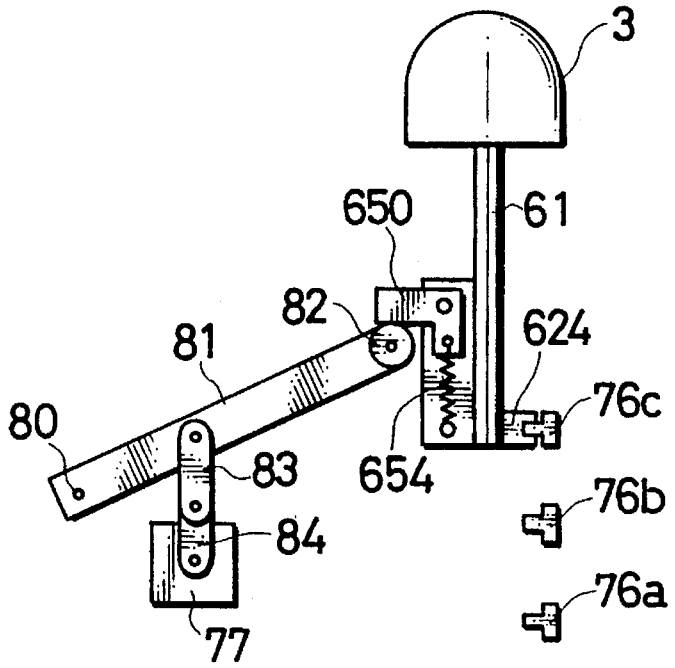
FIG. 13 is a diagram showing the appearance and disappearance operation of the bonus target, the bonus target reaching an uppermost position.

Referring to FIG. 12, if certain conditions to be discussed later are satisfied during execution of a game, the motor 77 is driven in its forward direction, causing the crank rod 84 to turn. The link rod 83 then turns the arm 81 in the counterclockwise direction so that the contact roller 82 pushes up the contact block 652 attached to the link member 650. (The contact block 652 is invisible in FIG. 12 since it is hidden behind the link member 650.) As a result, the bonus target 3 begins ascending from its lowermost initial position. In its ascending stroke, the bonus target 3 passes the position where detection of a hitting action is enabled (that is, where the hit sensor 76*b* detects a passage of the detecting tab 624). When the bonus target 3 reaches its uppermost position, the motor 77 is stopped (FIG. 13). The hit sensor 76*b* is provided to prevent detection of a false hitting action due to vibrations or shocks which may occur when the bonus target 3 begins its ascending motion or when the player accidentally hits the bonus target 3 before the bonus target 3 reaches its hittable position.

Figure 14:
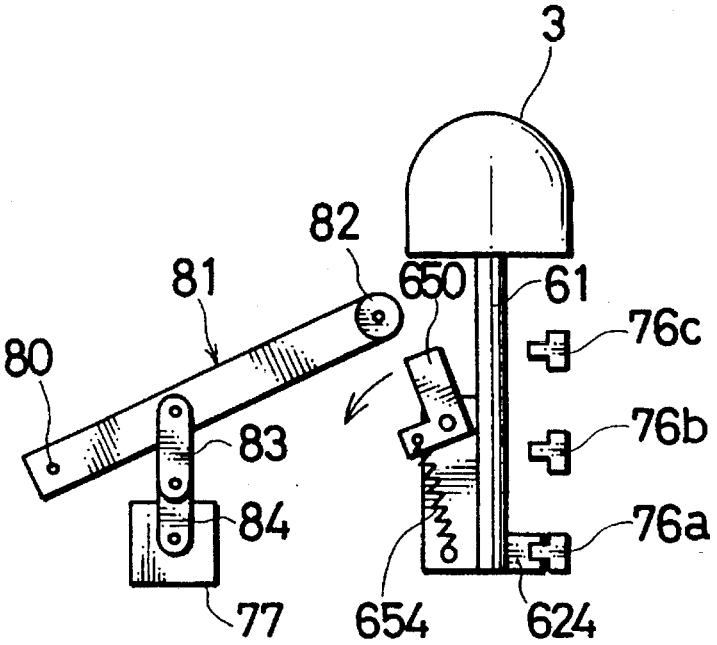
FIG. 14 is a diagram showing the appearance and disappearance operation of the bonus target, the bonus target descending to the lowermost position by its own weight.
Figure 15:
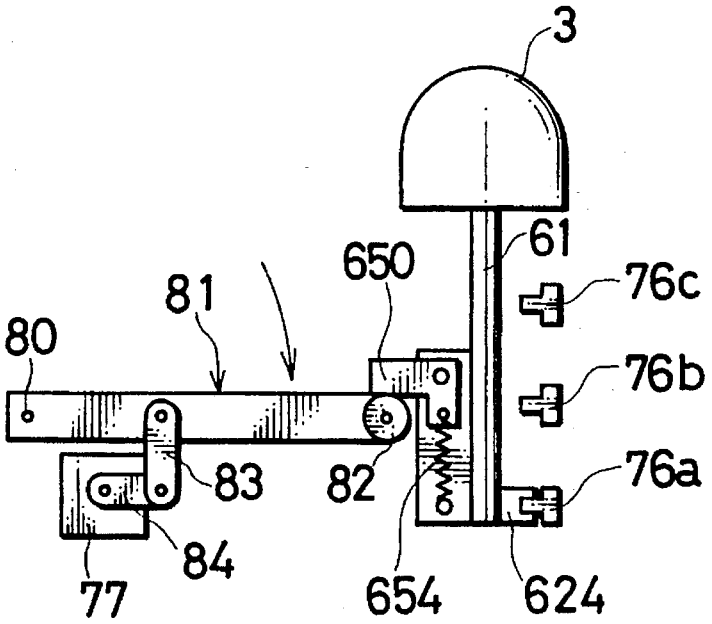
FIG. 15 is a diagram showing the appearance and disappearance operation of the bonus target, a contact roller returning to an initial position after running over a contact block.

If the bonus target 3 is hit at its uppermost position shown in FIG. 13, the resultant impact force causes the link member 650 to swing against the compressive force of the spring 654. Consequently, the link member 650 is released from the contact roller 82 and the bonus target 3 falls due to its own weight down to its initial position (FIG. 14). In the falling stroke of the bonus target 3, the hit sensor 76*b* detects a passage of the detecting tab 624. This confirms that the player has successfully hit the bonus target 3. When the bonus target 3 descends to its lowermost position and the initial position sensor 76*a* detects the detecting tab 624, the motor 77 is driven in its reverse direction to turn the arm 81 in the clockwise direction. At this point, the contact roller 82 presses the link member 650 downward to turn it counter-clockwise against the compressive force of the spring 654. As a result, the contact roller 82 runs over the contact block 652 attached to the link member 650 and returns to the initial position (FIG. 15). The ascending and descending strokes of the bonus target 3 can be equalized by applying the same number of pulses in mutually opposite phase or polarity. Alternatively, there may be provided another sensor to stop the motor 77 when the arm 81 has returned to its initial position.

Figure 16:
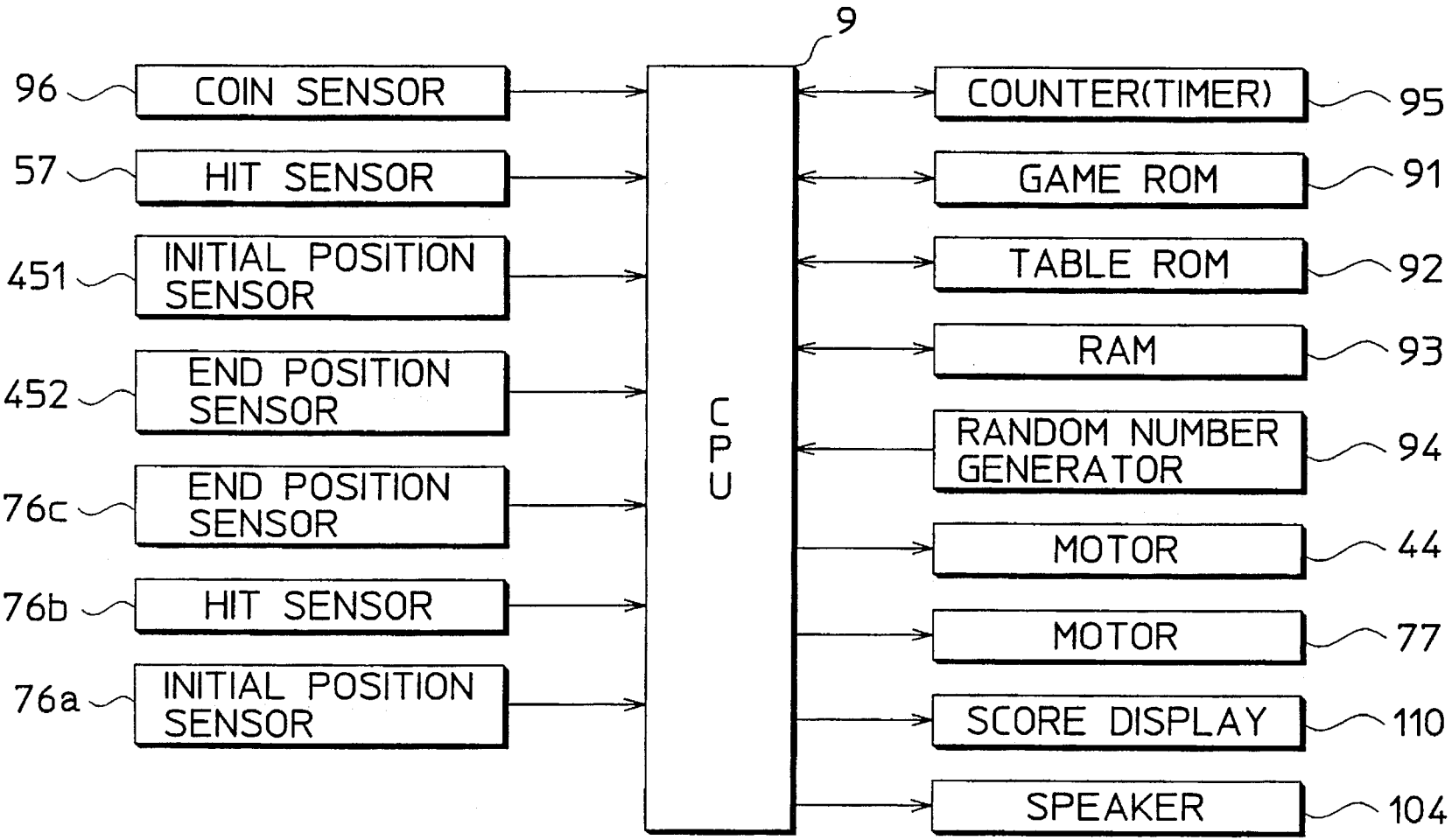
FIG. 16 is a block diagram showing a control system of the target hitting game machine.

FIG. 16 is a block diagram showing a control system of the target hitting game machine.

Indicated at numeral 9 is a central processing unit (hereinafter referred to as the CPU) including a microcomputer which controls the progress of a game in accordance with a game program stored in a read-only memory 91 (hereinafter referred to as the game ROM) and inputs from various sensors.

A read-only memory 92 (hereinafter referred to as the table ROM) stores a plurality of tables in which various parameters including random numbers, scores, the number of appearances of each target 2, execution or non-execution of a feint motion, and so on are registered. Emerging actions of the individual targets 2 and bonus targets 3 in each game are controlled in accordance with corresponding parameters read from a table selected from the stored set of tables. As an example, a plurality of candidate tables are selected from a plurality of table groups depending on the player's score and the number of appearances of each target 2 at a particular point of time in a game. Then, one table is selected from the candidate tables based on the random numbers. Each table registers target appearance data which determines which of the targets 2 (five in this embodiment) should emerge at a given time. The number of targets 2 emerging at the same time is not limited to one, but two or more targets 2 may emerge simultaneously. When either of the two bonus targets 3 is hit, data causing all the five targets 2 to emerge at once is selected. There may be provided a separate control routine for simultaneous emergence of all the targets 2 upon successful hitting at a bonus target 3 to facilitate the table selecting process. The aforementioned feint motion refers to a deceptive movement of a target 2, in which the target 2 comes up halfway and goes down to its hidden position without exposing the whole of its effective hitting area.

Indicated at numeral 93 is a random-access memory (hereinafter referred to as the RAM) for temporarily storing currently processed data, for instance. A random number generator 94 is for outputting parameters concerning the random numbers stored in the table ROM 92. The random numbers are outputted each time a table selection process is executed. It is to be noted that the game ROM 91, table ROM 92 and random number generator 94 are contained in a single ROM for the convenience of hardware configuration.

There is provided a counter (timer) 95 for administrating time and numerical data necessary to control the progress of each game. The counter 95 includes an error detection timer, a non-motion timer, a feint timer (for targets 2 only), a target appearance counter and a score counter. Preset values used as criteria in administrating time and the number of target appearances are stored in the game ROM 91. A coin sensor 96 includes a mechanical contact switch or an optical proximity switch, and detects a coin inserted from the coin slot 105. A game is started only after the coin sensor 96 has detected a coin.

Figure 17:
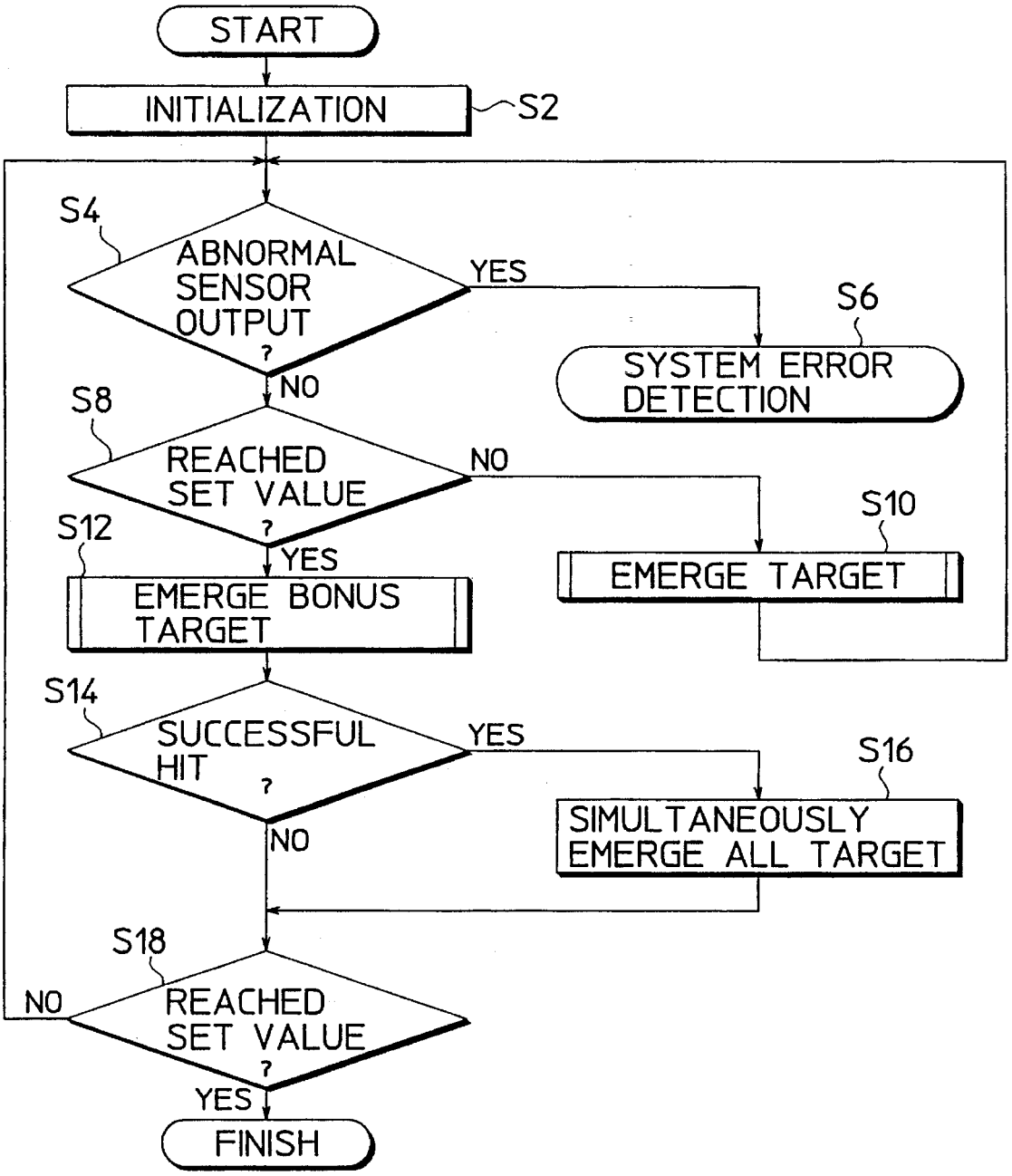
FIG. 17 is a flowchart showing an overall operating routine of the target hitting game machine.
Figure 18:
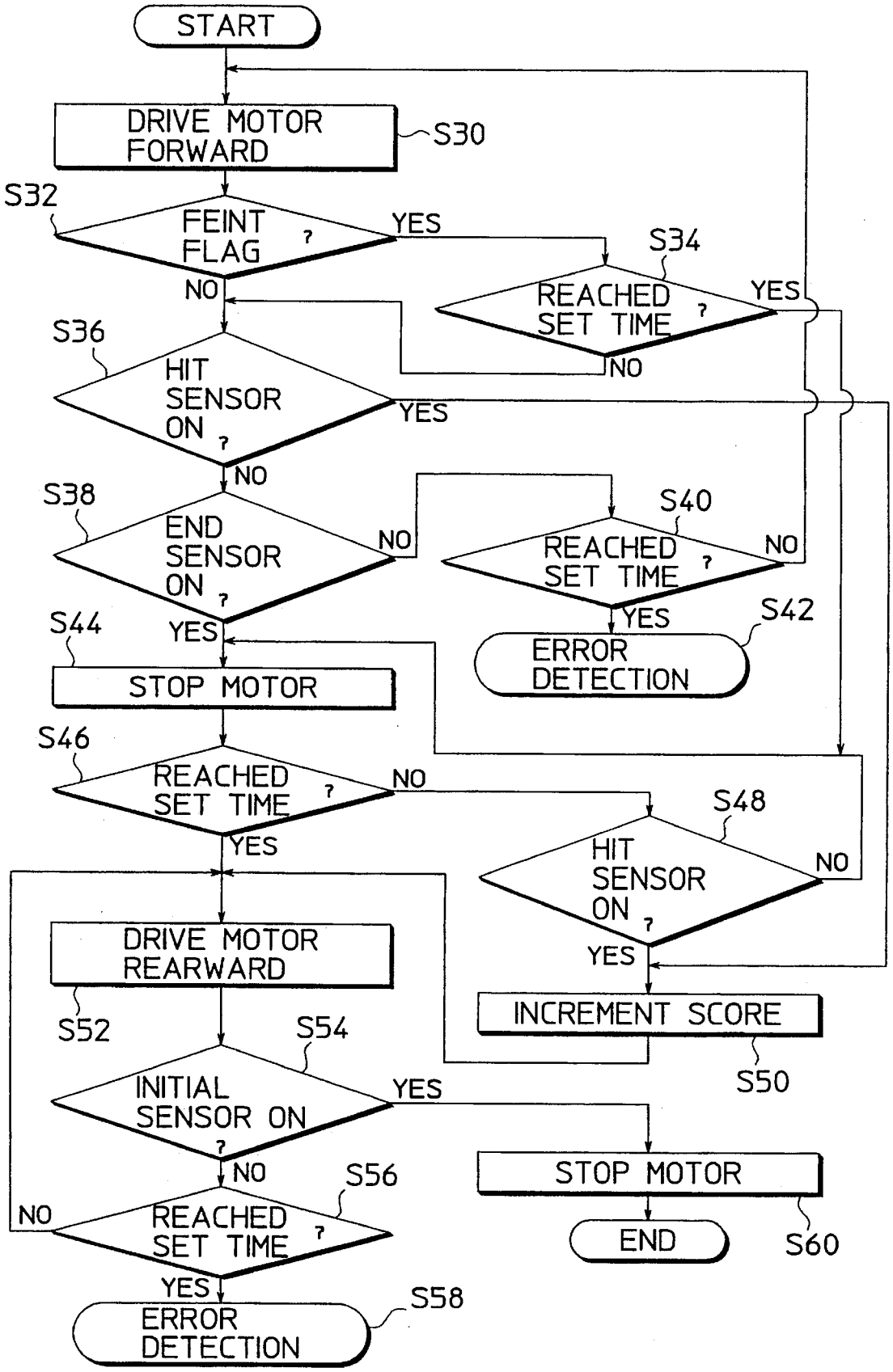
FIG. 18 is a flowchart showing the appearance and disappearance operation of each target.
Figure 19:
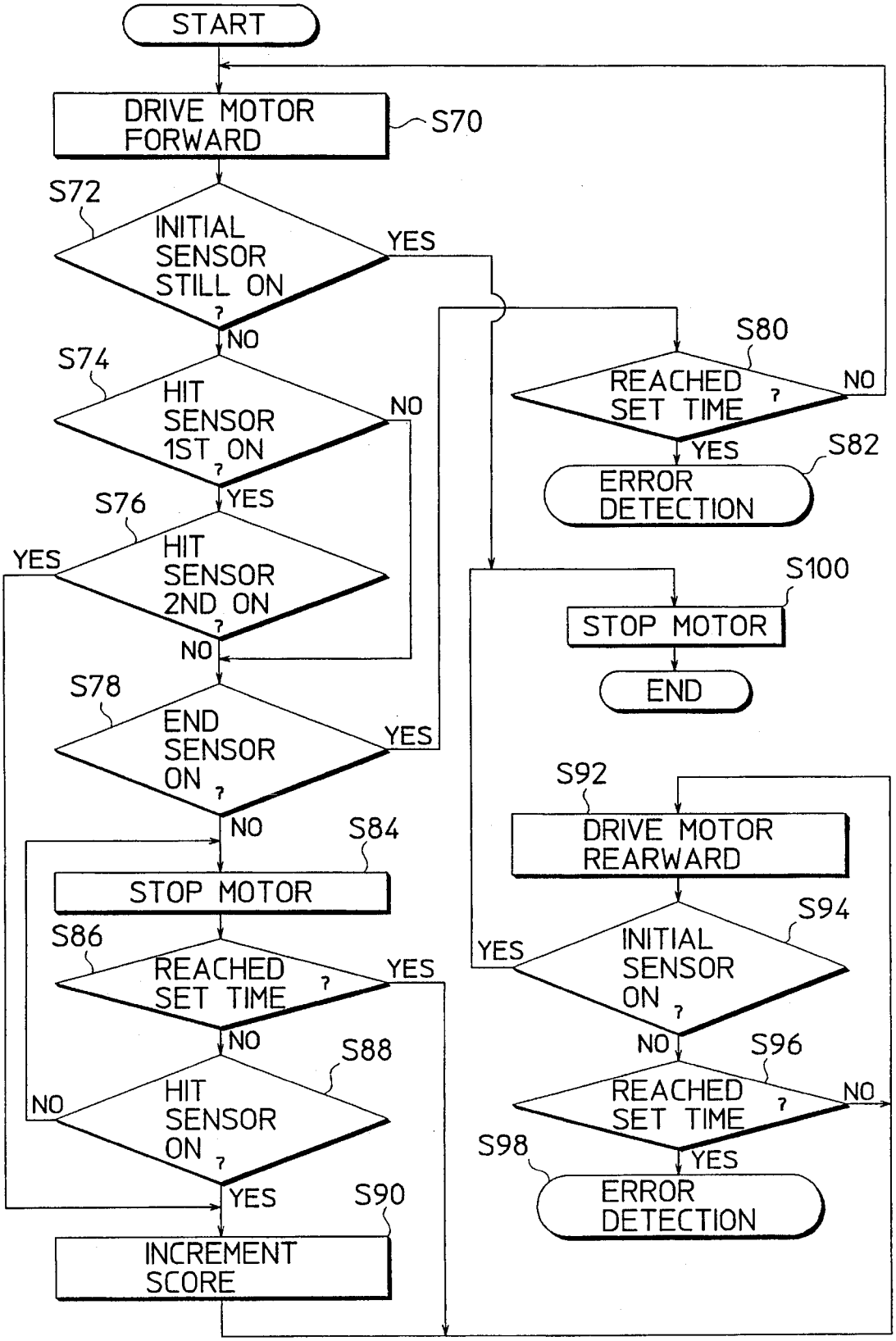
FIG. 19 is a flowchart showing the appearance and disappearance operation of each bonus target.

The operation of the target hitting game machine is now described referring to FIGS. 17–19. FIG. 17 is a flowchart showing an overall operating routine of the target hitting game machine; FIG. 18 is a flowchart showing the appearance and disappearance operation of each target 2; and FIG. 19 is a flowchart showing the appearance and disappearance operation of each bonus target 3.

Referring to FIG. 17, when the coin sensor 96 detects an inserted coin, a game is started and the target hitting game machine is initialized to reset its various elements to initial conditions (Step S2). Next, it is checked whether there is any abnormal sensor output which should not currently occur (Step S4). Should there exist any abnormal sensor output, it is judged that the relevant sensor is out of order or the CPU 9 is running out of control and, in this case, the operation flow proceeds to a system error detection subroutine (Step S6).

If no abnormal sensor output is found in Step S4, it is judged whether the number of appearances of the targets 2 counted by the target appearance counter has reached a set value (Step S8). If the number of target appearances has not reached the set value, one to four targets 2 are caused to emerge in accordance with target appearance data read from a table selected based on random numbers, scores, the number of previous target appearances, i.e., the value registered by the target appearance counter (Step S10). When emergence of the targets 2 has been finished, the operation flow returns to Step S4, where it is checked again whether there is any sensor output which should not currently occur. If no abnormal sensor output is found, the target appearance process of Steps S8 and S10 is re-executed. When the number of target appearances has reached the set value, one or two bonus targets 3 are caused to emerge based on random numbers (Step S12).

Next, it is judged whether the player has successfully hit every bonus target 3 that has emerged (Step S14). If the judgment result is in the affirmative, all the five targets 2 are caused to emerge simultaneously (Step S16). If the player has failed to hit every bonus target 3 that has emerged, no bonus point is added to the player's score and it is then judged whether the number of appearances of the bonus targets 3 has reached a set value (Step S18). If the number of bonus target appearances has not reached the set value, the operation flow returns to Step S4, from where Steps S4 to S16 are re-executed. When the number of bonus target appearances reaches the set value, it is judged that the current game has finished and the operation flow of FIG. 17 ends.

If both of the two bonus targets 3 emerge and the player succeeds to hit only one of them, a bonus point for that bonus target 3 may be preferably given to the player.

The operation concerning emergence of the individual targets is now described referring to the flowchart of FIG. 18. The motor 44 of a target 2 chosen to emerge in accordance with the target appearance data selected in Step S10 of FIG. 17 is driven in its forward direction from the initial position to the end position (Step S30). After the motor 44 has driven in the forward direction, it is judged whether a feint flag is set (Step S32). If a feint flag is set, the feint timer starts measuring, and the measurement of the feint timer is compared with a set time (Step S34). If the measurement of the feint timer is less than the set time (NO in Step S34), it is judged whether the hit sensor 57 is ON, that is, whether the player has successfully hit the target 2 (Step S36).

If the hit sensor 57 is ON, the operation flow proceeds to Step S50 where one point is added to the player's score. It is to be noted that the player's score is always displayed on the score display 110. If the hit sensor 57 is not ON, it is judged whether the end position sensor 452 has turned ON (Step S38). If the end position sensor 452 is not ON, a further judgment is made as to whether the error detection timer which started measuring from the beginning of forward rotation of the motor 44 has already reached a set time (Step S40). If the set time has not been reached, the operation flow returns to Step S30. If the set time has already been reached, the operation flow proceeds to an error detection subroutine (Step S42).

If the end position sensor 452 becomes ON within a set period of time in Step S38, the motor 44 is stopped (Step S44). The motor 44 is also stopped if the measurement of the feint timer reaches its set time in Step S34 (Step S44). This means that only part of the effective hitting area of the target 2 is exposed from the top of the playing board 101 when the target 2 makes a feint motion. The non-motion timer starts measuring when the motor 44 is stopped. Then, if the measurement of the non-motion timer is less than a set time (NO in Step S46), it is judged whether the hit sensor 57 has become ON (Step S48). If the hit sensor 57 is ON, the operation flow proceeds to Step S50, where the player's score is incremented one point. If the hit sensor 57 does not become ON until the non-motion timer reaches its set time, hitting at the target 2 is no longer accepted, that is, hitting at the target 2 does not yield any point. At this point, the motor 44 is set in the reverse direction (Step S52). Next, it is judged whether the initial position sensor 451 has become ON (Step S54). If the initial position sensor 451 is not ON, a further judgment is made as to whether the error detection timer which started measuring from the beginning of reverse rotation of the motor 44 has already reached a set time (Step S56). If the set time has already been reached, the operation flow proceeds to an error detection subroutine (Step S58). If the initial position sensor 451 becomes ON within a set period of time in Step S54, it is judged that the target 2 has properly returned to its initial position. In this case, the motor 44 is stopped (Step S60) and the operation flow of FIG. 18 ends.

Although the motor 44 is set in the reverse direction (Step S52) and hitting at the target 2 is no longer accepted when the non-motion timer reaches the set time in the embodiment, it may be possible that hitting at the target 2 is regarded effective for additional points until a specified time period is measured from the beginning of reverse rotation of the motor 44.

The emergence operation of the individual bonus targets 3 is now described referring to the flowchart of FIG. 19. The motor 77 of a bonus target 3 chosen to emerge based on random numbers in Step S12 of FIG. 17 is driven in its forward direction, causing the bonus target 3 to descend from its initial position to end position (Step S70). If the initial position sensor **76*a* is still ON two seconds after the beginning of forward rotation of the motor 77 (YES in Step S72), it is judged that the bonus target 3 has not actually ascended due to a system failure or that the initial position sensor 76***a* is abnormal. In this case, the motor 77 is stopped (Step S100) and the operation flow of FIG. 19 ends.

If the initial position sensor 76*a* is already OFF two seconds after the beginning of forward rotation of the motor 77 (NO in Step S72), it is regarded that the bonus target 3 has properly ascended, and a further judgment is made as to whether the hit sensor 76*b* has become ON for the first time (Step S74). If the hit sensor 76*b* has become once ON, it means that the bonus target 3 has already ascended to its hittable position. In this case, it is judged whether the initial position sensor 76*a* has become ON for the second time (Step S76).

The hit sensor 76*b* becomes ON for the second time only when the player hits the bonus target 3. If the hit sensor 76*b* has become ON for the second time, the operation flow proceeds to Step S90, where one point is added to the player's score. If the hit sensor 76*b* has not become ON either for the first time or the second time, it is judged whether the end position sensor 76*c* is ON (Step S78). If the end position sensor 76*c* is not ON yet, a further judgment is made as to whether the error detection timer which started measuring from the beginning of forward rotation of the motor 77 has already reached a set time (Step S80). If the set time has not been reached yet, the operation flow returns to Step S70. If the set time has already been reached, the operation flow proceeds to an error detection subroutine (Step S82).

If the hit sensor 76*b* does not become ON until the end position sensor 76*c* becomes ON, the motor 77 is stopped since the bonus target 3 has already reached its uppermost position (Step S84). The non-motion timer starts measuring when the motor 77 is stopped. Then, if the measurement of the non-motion timer is less than a set time (NO in Step S86), it is judged whether the hit sensor 76*b* has become ON (Step S88). If the hit sensor 76*b* is ON, the operation flow proceeds to Step S90 where the player's score is increment one point. If the hit sensor 76*b* is not ON, the operation flow returns to Step S84. If the hit sensor 76*b* does not become ON until the non-motion timer reaches its set time, hitting at the bonus target 3 is no longer accepted, that is, hitting at the bonus target 3 does not yield any point, the operation flow proceeds to Step S92 where the motor 77 is set in the reverse direction. Next, it is judged whether the initial position sensor 76*a* has become ON (Step S94). If the initial position sensor 76*a* is not ON, a further judgment is made as to whether the error detection timer which started measuring from the beginning of reverse rotation of the motor 77 has already reached a set time (Step S96). If the set time has already been reached, the operation flow proceeds to an error detection subroutine (Step S98). If the initial position sensor 76*a* becomes ON within a set period of time in Step S94, it is judged that the bonus target 3 has properly returned to its initial position. In this case, the motor 77 is stopped (Step S100) and the operation flow of FIG. 19 ends.

As previously mentioned, targets of the conventional target hitting game machines reciprocate between their hidden and exposed positions and a player can easily determine whether to strike a particular target depending on whether it can be seen from the player's viewpoint. In this embodiment, the effective hitting area and mishit area of each target 2 alternate with its simple rotary motion. It is therefore more difficult to determine optimum timing of hitting and more exciting to play games on the target hitting machine of the present invention.

The embodiment may additionally be provided with a speaker for producing a sound in the event of successful hitting at a target 2 or bonus target 3, controlled by the CPU 9. Different sounds may be generated depending on whether the hitting has been successful or not to offer more amusement and excitement.

It is to be understood that the above-described embodiment is simply illustrative of the invention. The embodiment may be modified as described below, for instance, without departing from the spirit of the invention:

1) Although the base 10 of the target hitting game machine is relatively large in the embodiment to suit its intended use, the base 10 can be made significantly small depending on the form of application of the game machine because the target 2 is rotatable.

2) Although each target 2 is turned by driving the relevant motor 44 in its forward and reverse directions the embodiment, it is possible to turn the target 2 with one-directional rotation of the motor 44 to simplify the circuit configuration.

3) With additional provision of a position sensor, hitting at each target 2 may be regarded as successful only if it is directed in a certain range of direction during forward rotation of the relevant motor 44 (or when the motor 44 is stationary, or regardless of whether the motor 44 is rotating or stationary). Other variations are also possible depending on the type of target to which the position sensor is provided.

4) The number of successful hits (or the player's score) may be audibly annunciated by the aforementioned speaker in stead of or in addition to the indication on the score display 110.

5) Although hitting at each target 2 is detected based on angular displacement of the rocking shaft 53 in the embodiment, there may be mounted an elastic member on the bottom of the base plate 50 so that vertical displacement of the elastic member due to its vibration resulting from an impact force could be detected. This arrangement provides a target hitting detection mechanism having a simplified construction.

6) The targets 2 and bonus targets 3 are not limited to the spherical shapes, but various other shapes can be employed depending on the type of games. Polyhedron is also their preferable shape, for instance.

7) The shape of the effective hitting area on a target 2 is not limited to a hemisphere, but may be a segment of sphere smaller than the hemisphere depending on the type of targets. Furthermore, instead of providing one effective hitting area on part of the spherical surface, a specified number of effective hitting areas may be provided on the spherical surface, which serves to enhance attractiveness of games depending on the type of targets.

8) Although successful hitting on a bonus target 3 causes all the targets 2 to emerge at once in the embodiment, various modifications are possible with respect to the treatment of the bonus targets 3. Twice as high points may be given in reward for successful hitting, for example, to thereby enhance attractiveness of games.

9) A variety of preprogrammed target appearance patterns may be stored in a memory from which one pattern is selected based on random numbers at the beginning of each game. This arrangement makes it easier to provide variations in the behavior of the individual targets 2 and bonus targets 3.

10) Although the motor 77 of each bonus target 3 is driven in its reverse direction in order to reset the bonus target 3 from its raised position to the initial position in the embodiment, resetting to the initial position may be achieved by a continued forward rotation of the motor 77 as the arm 81 of the elevating crank mechanism 8 has a continuously rotatable construction. This arrangement is advantageous in that rotation of the motor 77 needs to be controlled in one direction only.

11) Although the targets 2 are mounted on the horizontal playing board 101 in the embodiment, it is possible to mount them on a sloping or vertical playing board.

What is claimed is:

1. A target hitting game machine comprising:

a cover member being formed with an opening;

a target having an effective hitting area on a portion of the surface thereof, the target being rotatably disposed in the cover member and partially exposed through the opening during the rotation;

a drive mechanism which rotates the target;

an exposure detector which detects that the effective hitting area of the target is exposed through the opening;

a hit detector which senses that the target is hit by a player; and a successful hitting determinator which is in responsive to the exposure detector and the hit detector and determines a successful hitting that the effective hitting area is hit.

2. A target hitting game machine according to claim 1, further comprising a rotary shaft which is rotatably provided in the cover member and on which the target is fixedly attached, wherein the drive mechanism includes a driver for providing a driving torque to the rotary shaft.

3. A target hitting game machine according to claim 2, further comprising a support member which is provided in the cover member and supports the rotary shaft swingably, wherein the hit detector includes a sensor which senses a swing of the rotary shaft.

4. A target hitting game machine according to claim 1, wherein the target is in the form of a ball.

5. A target hitting game machine according to claim 4, wherein the effective hitting area is formed on a half of the surface of the target.

6. A target hitting game machine according to claim 1, wherein the successful hitting determinator includes an adder which performs mathematical addition to calculate the number of successful hittings.

7. A target hitting game machine according to claim 6, wherein the successful hitting determinator further includes a display which displays a result of the adder.

8. A target hitting game machine according to claim 1, wherein:

the cover member is formed with a plurality of openings; and for each opening, the target, the drive mechanism, the exposure detector, the hit detector, and the successful hitting determinator are provided in the cover member.

9. A target hitting game machine according to claim 1, wherein the cover member is further formed with a secondary opening, further comprising:

a secondary target; and a secondary drive mechanism which moves the secondary target to an emerging position of emerging from the secondary opening from a hiding position of hiding in the cover member, and vice versa.

10. A target hitting game machine according to claim 9, further comprising a controller for controlling the drive mechanism to expose the effective hitting area of the target when the secondary target is successfully hit.

* * * * *